US010718552B2

(12) United States Patent
Park et al.

(10) Patent No.: US 10,718,552 B2
(45) Date of Patent: Jul. 21, 2020

(54) REFRIGERATOR

(71) Applicant: LG Electronics Inc., Seoul (KR)

(72) Inventors: Yoomin Park, Seoul (KR); Jinho Son, Seoul (KR); Hozin Song, Seoul (KR)

(73) Assignee: LG Electronics Inc., Seoul (KR)

( * ) Notice: Subject to any disclaimer, the term of this patent is extended or adjusted under 35 U.S.C. 154(b) by 149 days.

(21) Appl. No.: 15/959,671

(22) Filed: Apr. 23, 2018

(65) Prior Publication Data

US 2018/0347871 A1 Dec. 6, 2018

(30) Foreign Application Priority Data

Jun. 1, 2017 (KR) ..... 10-2017-0068216

(51) Int. Cl.
*F25D 23/04* (2006.01)
*A47B 88/40* (2017.01)
(Continued)

(52) U.S. Cl.
CPC ..... *F25B 21/04* (2013.01); *A47F 1/00* (2013.01); *F25B 21/02* (2013.01); *F25D 11/025* (2013.01);
(Continued)

(58) Field of Classification Search
CPC ..... F25D 23/04; F25D 23/12; F25D 23/025; F25D 23/123; F25D 11/02; F25D 11/025;
(Continued)

(56) References Cited

U.S. PATENT DOCUMENTS 4,852,856 A † 8/1989 Correll
5,462,111 A † 10/1995 Wardle
(Continued)

FOREIGN PATENT DOCUMENTS

JP H07-218085 8/1995
JP 2013-068353 4/2013
KR 1020160022710 3/2016

OTHER PUBLICATIONS

European Search Report in European Appln. No. 18165187.8, dated Dec. 17, 2018, 13 pages.
(Continued)

*Primary Examiner* — Frantz F Jules
*Assistant Examiner* — Erik Mendoza-Wilkenfel
(74) *Attorney, Agent, or Firm* — Fish & Richardson P.C.

(57) ABSTRACT

Provided is a refrigerator. The refrigerator includes a main body defining a storage space, a cryogenic freezing compartment provided in the storage space, and a thermoelectric module assembly disposed at one side of the cryogenic freezing compartment so that the cryogenic freezing compartment is cooled to a temperature less than that of the storage space. The cryogenic freezing compartment includes a cryogenic case into which an insulation material is filled to be thermally insulated from the storage space and in which a cryogenic freezing space is defined, a case door opening and closing the cryogenic case, and a rail assembly connecting the cryogenic case to the case door and extending and contracted in multi-stages to allow the case door to be slid to be inserted and withdrawn. The rail assembly is mounted on the cryogenic case outside the cryogenic freezing space.

18 Claims, 18 Drawing Sheets

(51) Int. Cl.

| | |
|---|---|
| ***F25B 21/02*** | (2006.01) |
| ***F25D 23/12*** | (2006.01) |
| ***F25D 11/02*** | (2006.01) |
| ***F25B 21/04*** | (2006.01) |
| ***F25D 25/02*** | (2006.01) |
| ***A47F 1/00*** | (2006.01) |
| ***F25D 23/08*** | (2006.01) |
| ***F25D 23/06*** | (2006.01) |
| ***F25D 23/00*** | (2006.01) |
| ***F25D 23/02*** | (2006.01) |

(52) U.S. Cl.
CPC ..... *F25D 23/006* (2013.01); *F25D 23/028* (2013.01); *F25D 23/067* (2013.01); *F25D 23/087* (2013.01); *F25D 25/025* (2013.01); *F25D 23/025* (2013.01)

(58) Field of Classification Search
CPC ..... A47B 88/40; A47B 88/402; A47B 88/477; A47B 88/493; F25B 21/02
See application file for complete search history.

(56) References Cited

U.S. PATENT DOCUMENTS

| | | | | |
|---|---|---|---|---|
| 2006/0021373 | A1 | 2/2006 | Oh et al. | |
| 2008/0302441 | A1 | 12/2008 | Kelly et al. | |
| 2011/0006652 | A1 | 1/2011 | Veltrop | |
| 2011/0050065 | A1 | 3/2011 | Lee et al. | |
| 2011/0214448 | A1* | 9/2011 | Youn | A23L 3/363 62/449 |
| 2011/0283716 | A1† | 11/2011 | Newman | |
| 2012/0304667 | A1* | 12/2012 | Shin | F25B 21/02 62/3.6 |
| 2014/0252938 | A1 | 9/2014 | Kim et al. | |
| 2015/0150375 | A1* | 6/2015 | Brock | A47B 88/493 312/334.38 |
| 2016/0377329 | A1 | 12/2016 | Shin et al. | |

OTHER PUBLICATIONS

Partial European Search Report in European Application No. 18165187.8, dated Sep. 13, 2018, 13 pages.
EP Office Action in European Application No. EP EP18465487, dated Oct. 29, 2019, 6 pages.

* cited by examiner
† cited by third party

REFRIGERATOR

CROSS-REFERENCE TO RELATED APPLICATIONS

The present application claims priority under 35 U.S.C. 119 and 35 U.S.C. 365 to Korean Patent Application No. 10-2017-0068216, filed on Jun. 1, 2017, which is hereby incorporated by reference in its entirety.

FIELD

The present disclosure relates to a refrigerator including cryogenic freezing compartment.

BACKGROUND

Generally, refrigerators are household appliances that store foods at a low temperature. An inner space of such as a refrigerator may be divided into a refrigerating compartment and a freezing compartment according to temperatures for foods stored in the refrigerator. The refrigerating compartment generally maintains a temperature of about 3 degrees Celsius to about 4 degrees Celsius, and the freezing compartment generally maintains a temperature of about −20 degrees Celsius.

The freezing compartment having a temperature of about −20 degrees Celsius is a space in which foods are kept in a frozen state and is often used by consumers to store the foods for a long time. However, in the existing freezing compartment, which maintains a temperature of about −20 degrees Celsius, when water within cells is frozen while freezing meat or seafood, a phenomenon in which water is exuded out of the cells may occur, and thus, the cells are destroyed. As a result, when cooking the foods after thawing, their original taste may be lost, or the texture may change.

On the other hand, when meat or seafood is frozen, the temperature rapidly passes through the freezing point temperature zone in which intracellular ice is formed to minimize the cell destruction. Thus, even after thawing, meatiness and texture may be renewed or reproduced freshly to make it possible to enjoy delicious dishes.

As the case stands, fancy restaurants use a cryogenic freezer that is capable of rapidly freezing meat, fish, and seafood. However, unlike restaurants that need to preserve large quantities of foods, since it is not always necessary to use the cryogenic freezer in ordinary homes, it is not easy to separately purchase the cryogenic freezer that is used in restaurants.

However, as the quality of life has improved, consumers' desire to eat more delicious foods has become stronger to lead to an increase in consumers who want to use the cryogenic freezer.

In order to meet the needs of such consumers, there has been developed a household refrigerator in which a cryogenic freezing compartment is installed in a portion of the freezing compartment. It is preferable that the cryogenic freezing compartment satisfies a temperature of about −50 degrees Celsius, such an extremely low temperature is a temperature that is not attained only by a refrigeration cycle using a general refrigerant.

Accordingly, there has been developed a household refrigerator in which a cryogenic freezing compartment is separately provided in the freezing compartment in a manner in which cooling is performed by using a refrigeration cycle up to a temperature of −20 degrees Celsius and by using a thermoelectric module (TEM) in case of cryogenic refrigeration.

However, since a temperature difference between the freezing compartment of about −20 degree Celsius and a cryogenic freezing compartment of about −50 degree Celsius is very large, it is not easy to realize a temperature of about −50 degrees Celsius by applying a structure for insulation, defrosting, cold air supply, and the like, which was applied to the design of the existing freezing compartment, to the cryogenic freezing compartment as it is.

Also, when a cryogenic freezing compartment, which occupies a space of the freezing compartment itself, is provided, since reduction in volume capacity of the freezing compartment has to be minimized, it is necessary to minimize a space occupied by the structure for cooling and circulating cold air in the cryogenic freezing compartment.

Particularly, when the cryogenic temperature is implemented using the TEM, heat exchange has to be smoothly performed both at a heat absorption side and a heat generation side of the TEM, cold air cooled by the heat exchange at the heat absorption side has to smoothly circulate, and heat exchange loss and flow loss should not occur while having a simple structure as much as possible.

Furthermore, due to the volume occupied by the TEM and related components, which are installed to achieve the cryogenic temperature, there is a possibility that a flow rate or pressure distribution in the existing grill fan assembly structure changes, and thus, the freezing in the freezing compartment is not smoothly performed.

SUMMARY

Embodiments provide a refrigerator in which a cryogenic compartment door of an independent cryogenic freezing compartment, which is cooled at an extremely low temperature by a thermoelectric module, is slid to be smoothly inserted into and withdrawn from the inside of the storage space.

Embodiments also provide a refrigerator which is capable of being improved in withdrawal performance of an accommodation member within a cryogenic freezing compartment that is cooled at an extremely low temperature to improve accommodation and use convenience.

Embodiments also provide a refrigerator which is capable of improving sealing performance of a cryogenic freezing compartment that is cooled at an extremely low temperature.

In one embodiment, a refrigerator includes: a main body defining a storage space; a cryogenic freezing compartment provided in the storage space; and a thermoelectric module assembly disposed at one side of the cryogenic freezing compartment so that the cryogenic freezing compartment is cooled to a temperature less than that of the storage space, wherein the cryogenic freezing compartment includes: a cryogenic case into which an insulation material is filled to be thermally insulated from the storage space and in which a cryogenic freezing space is defined; a case door opening and closing the cryogenic case; and a rail assembly connecting the cryogenic case to the case door and extending and contracted in multi-stages to allow the case door to be slid to be inserted and withdrawn, wherein the rail assembly is mounted on the cryogenic case outside the cryogenic freezing space.

A rail mounting part to which the rail assembly is fixed and mounted may be disposed on a bottom surface of the cryogenic case.

The refrigerator may further include a rail cover fixed to a rear surface of the case door and extending along the rail assembly to cover the rail assembly, wherein a cover guide part accommodating the rail cover when the case door is inserted and withdrawn may be provided on the bottom surface of the cryogenic case.

The rail cover may include: a cover part extending from both lower ends of the case door up to a front surface of the cryogenic case; and a cover fixing part bent upward from a front end of the cover part and coupled and fixed to the inside of the case door.

The cover part may include: a coupling surface coupled to the rail assembly to move together as the rail assembly is inserted and withdrawn; a covering surface bent from an outer end of the coupling surface to cover an exposed portion of the rail assembly; and a guide surface bent from the outer end of the coupling surface facing the covering surface in a direction opposite to the covering surface to guide the insertion and withdrawal of the rail cover.

A support frame in which a food is accommodated may be disposed on a rear surface of the case door, and the support frame may be inserted into and withdrawn from the cryogenic freezing space within the cryogenic case as the case door is opened and closed.

The support frame may include: a pair of frame fixing parts fixed to a rear surface of the case door to extend vertically; and a support plate extending backward from a lower end of the pair of frame fixing parts to support the food at an upper side of the rail assembly.

A cryogenic accommodation part in which the food is accommodated may be seated on the support plate, and the cryogenic accommodation member may be completely withdrawn to the outside of the cryogenic case in a state in which the case door is maximally opened.

A spacer coming into contact with an inner surface of the cryogenic freezing compartment to guide the insertion and withdrawal of the support frame may be disposed on a rear end of each of both surfaces of the support frame.

The spacer may be made of an engineering plastic material having excellent abrasion resistance and excellent lubrication performance.

The spacer may move while maintaining the contact state with both edges of a lower end of the inner surface of the cryogenic freezing compartment.

The spacer may include: a side part coming into contact with a side surface within the cryogenic freezing compartment; and a bottom part bent from a lower end of the side part to come into contact with a bottom surface within the cryogenic freezing compartment.

An insertion fixing part inserted by passing through the support frame may be disposed on an upper end of the side part, and a bent part bent upward to accommodate an end of the support frame may be disposed on an extending end of the bottom part.

A cryogenic gasket coming into contact with a front surface of the cryogenic case may be disposed on a circumference of a rear surface of the case door, and the gasket may include: a gasket mounting part mounted on the rear surface of the gasket door; and a sealing part protruding from the gasket mounting part to come into contact with the cryogenic case and defining a space therein.

An insulation member made of a material having an insulation properties and elasticity and filling at least a portion of the inner space of the sealing part may be disposed in the sealing part.

A case protrusion inserted into an opening of the front surface of the cryogenic case may be disposed on a center of the case door, and the cryogenic gasket may be disposed on a circumference of the gas protrusion.

A gasket opening that is opened toward the gasket protrusion may be defined in the sealing part.

The details of one or more embodiments are set forth in the accompanying drawings and the description below. Other features will be apparent from the description and drawings, and from the claims.

DETAILED DESCRIPTION OF THE EMBODIMENTS

Hereinafter, preferred embodiments will be described in more detail with reference to the accompanying drawings.

The present invention may, however, be embodied in different forms and should not be construed as limited to the embodiments set forth herein. Rather, these embodiments are provided so that the present invention will be thorough and complete, and will fully convey the scope of the present invention to those skilled in the art.

Hereinafter, preferred embodiments will be described in more detail with reference to the accompanying drawings.

The present invention may, however, be embodied in different forms and should not be construed as limited to the embodiments set forth herein. Rather, these embodiments are provided so that the present invention will be thorough and complete, and will fully convey the scope of the present invention to those skilled in the art.

In this specification, the term "cryogenic temperature" means a temperature that is lower than about 20 degrees Celsius, which is a typical freezing storage temperature of the freezing compartment, and the temperature range is not limited numerically. Also, even in the cryogenic freezing compartment, the storage temperature may be below about 20 degrees Celsius or more.

Figure 1:
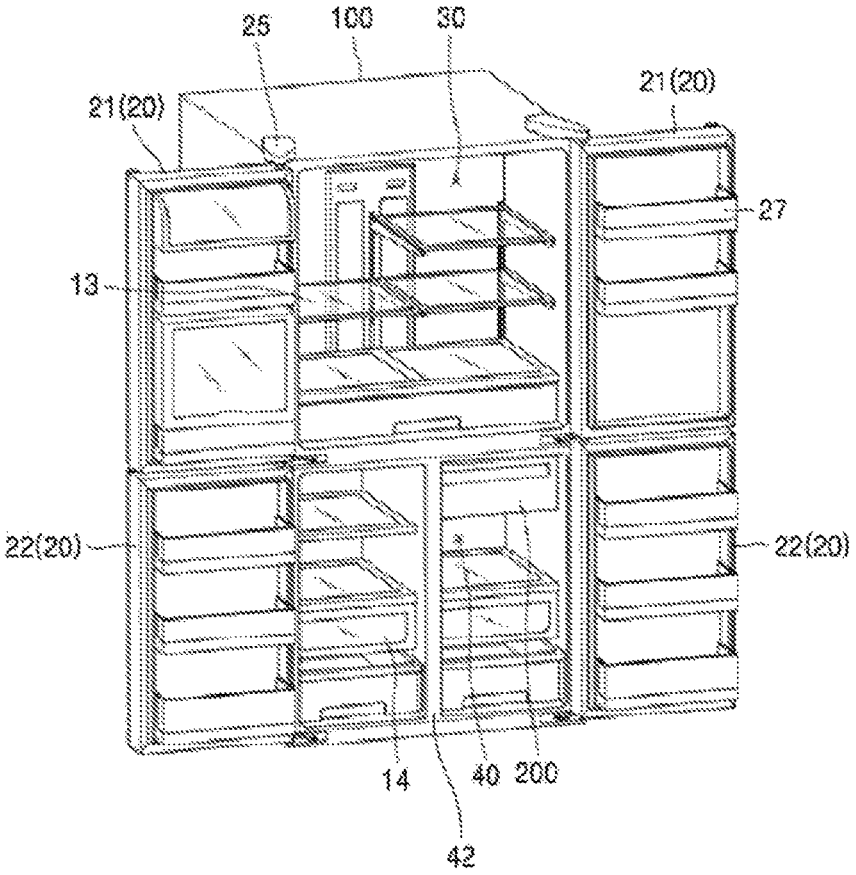
FIG. 1 is a perspective view of a refrigerator with a door opened according to an embodiment.
Figure 2:
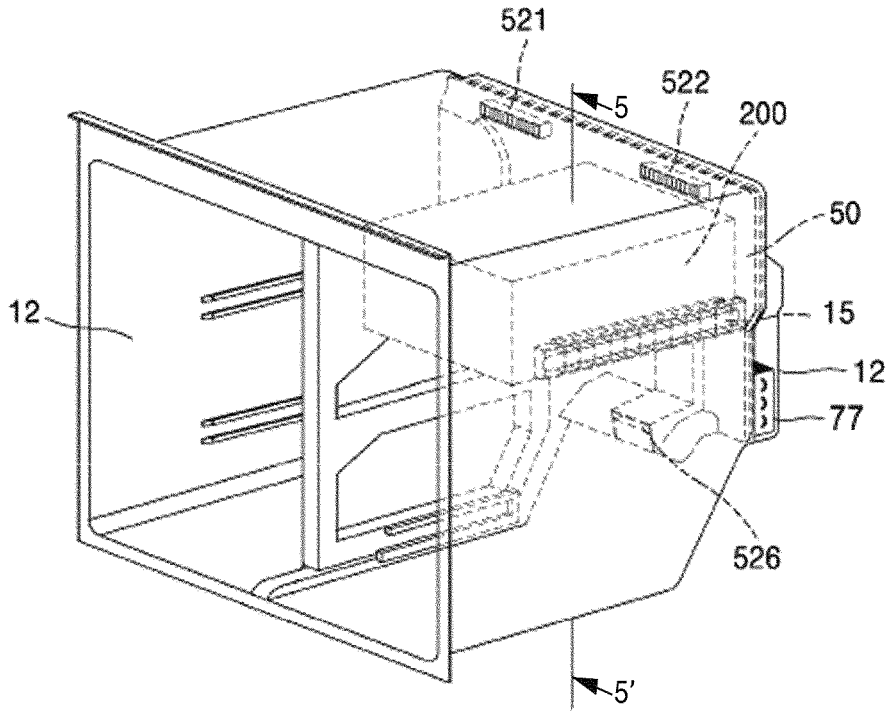
FIG. 2 is a perspective view illustrating an inner structure of an inner case of the refrigerator.

FIG. 1 is a perspective view of a refrigerator with a door opened according to an embodiment. Also, FIG. 2 is a perspective view illustrating an inner structure of an inner case of the refrigerator.

As illustrated in the drawings, a refrigerator according to an embodiment includes a refrigerator main body 10 and a refrigerator door 20 disposed on a front portion of the main body 10 to open and close each spaces of the main body 10. The refrigerator according to an embodiment has a bottom freezer type structure in which a refrigerating compartment 30 is disposed at an upper side, and a freezing compartment 40 is disposed at a lower side. The refrigerating compartment and the freezing compartment include side-by-side doors 21 and 22 that rotate with respect to hinges 25 disposed on both ends to open the refrigerating compartment and the freezing compartment. However, the embodiments are not limited to the refrigerator having the bottom freezer type structure. For example, the embodiments may be applied to a refrigerator having the side by side structure in which the refrigerating compartment and the freezing compartment are respectively disposed at left and right sides and a refrigerator having a top mount type structure in which the freezing compartment is disposed above the refrigerating compartment as lone as a cryogenic freezing compartment is capable of being installed in the freezing compartment.

The refrigerator main body 10 includes an outer case 11 defining an outer appearance of the refrigerator and an inner case 12 installed to be spaced a predetermined distance from the outer case 11 and defining an inner appearance of the refrigerator. An insulation material may be foamed and filled into a space between the outer case 11 and the inner case 12 to insulate the refrigerating compartment 30 and the freezing compartment 40 from an indoor space.

A shelf 13 and a drawer 14 are installed in the storage space of each of the refrigerating compartment 30 and the freezing compartment 40 to store foods while improving space utilization efficiency. The shelf 13 and the drawer 14 may be installed in the storage space so as to be guided along a case mounting part 15 disposed on left and right sides. A door basket 27 is installed inside the refrigerating compartment door 21 and the freezing compartment door 22 as illustrated in the drawings to store containers such as beverage bottles.

A cryogenic freezing compartment 200 according to an embodiment is provided in the freezing compartment 40. A space of the freezing compartment 40 is horizontally divided to be efficiently used. Here, the space of the freezing compartment 40 is partitioned by a partition wall 42 disposed at a center of the freezing compartment 40 and having a shape that vertically extends. Referring to FIG. 2, the partition wall 42 is installed to be fitted inward from the front portion of the main body and supported within the freezing compartment 40 through an installation guide 42-1 disposed on the bottom of the refrigerator. According to an embodiment, the cryogenic freezing compartment 200 may be disposed at a left upper portion of the freezing compartment 40 as one example. However, the position of the cryogenic freezing compartment 200, which is disposed in the freezing compartment 40, is not limited thereto. That is, the cryogenic freezing compartment 200 may be installed in the refrigerating compartment 30. However, when the cryogenic freezing compartment 200 is disposed in the freezing compartment 40, since a temperature difference between the inside and the outside (a freezing compartment atmosphere) of the cryogenic freezing compartment is more less, it is more advantageous that the cryogenic freezing compartment 200 is installed in the freezing compartment 40 in views of cold air leakage prevention.

A machine room isolated from the freezing compartment is disposed in a rear lower portion of the freezing compartment 40. A compressor 71 and a condenser 73 of a refrigeration cycle cooling device 70 using a refrigerant are disposed in the machine room. A grill fan assembly 50 including a grill fan 51 defining a rear wall of the freezing compartment 40 and a shroud 56 coupled to a rear portion of the grill fan 51 to distribute cold air within a cooling chamber is installed between a space defining the freezing compartment 40 and a rear wall of the inner case 12. Also, an evaporator 77 of the refrigeration cycle cooling device 70 is installed in a predetermined space between the grill fan assembly 50 and the rear wall of the inner case 12. When the refrigerant within the evaporator 77 is evaporated, the refrigerant is heat-exchanged with air flowing through the inner space of the freezing compartment 40. The air cooled by the heat exchange is distributed into a cold air distribution space defined by the grill fan 51 and the shroud 56 to flow through the freezing compartment 40, thereby performing the cooling in the freezing compartment 40.

Figure 3:
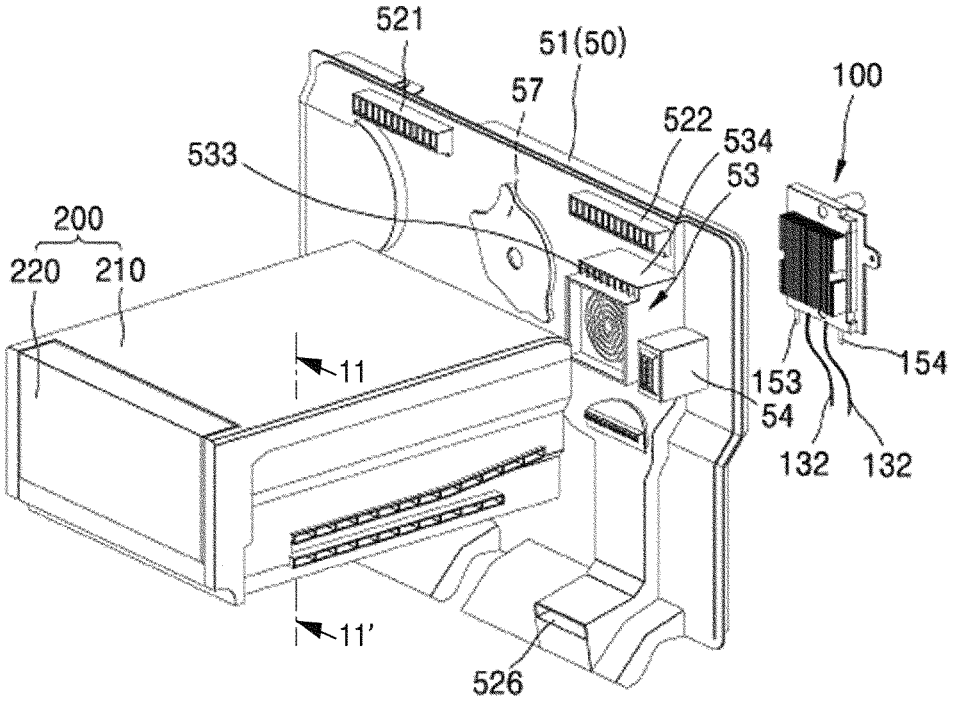
FIG. 3 is an exploded front perspective view of a coupling structure of a grill fan assembly, a cryogenic freezing compartment, and a thermoelectric module assembly according to an embodiment.
Figure 4:
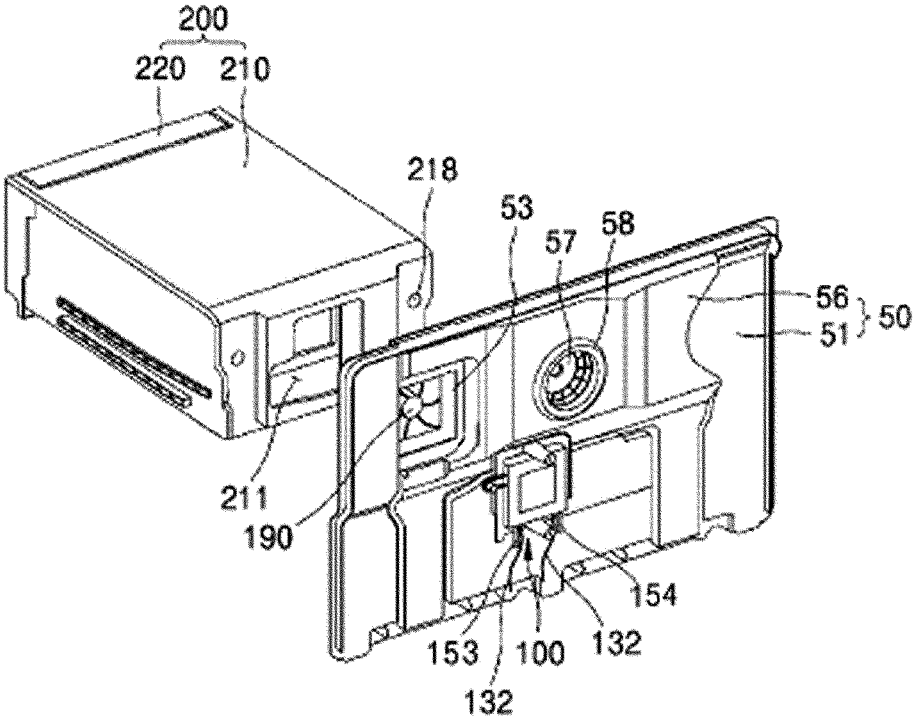
FIG. 4 is an exploded rear perspective view of the coupling structure of the grill fan assembly, the cryogenic freezing compartment, and the thermoelectric module assembly.

FIG. 3 is an exploded front perspective view of a coupling structure of the grill fan assembly, the cryogenic freezing compartment, and a thermoelectric module assembly according to an embodiment. Also, FIG. 4 is an exploded rear perspective view of the coupling structure of the grill fan assembly, the cryogenic freezing compartment, and the thermoelectric module assembly.

As illustrated in the drawings, according to an embodiment, the grill fan assembly 50 to which the cryogenic freezing compartment is applied includes the grill fan 51 defining the rear wall of the freezing compartment 40 and the shroud 56 for distributing the cold air, which is cooled by being heat-exchanged with the evaporator 77 on a rear surface of the grill fan 51, to supply the cold air into the freezing compartment 40.

As illustrated in the drawings, cold air discharge holes 52 provided as passages through which the cold air is discharged forward are defined in the grill fan 51. In this embodiment, the cold air discharge holes 52 are defined in upper end left/right sides 521 and 522, central left/right sides 523 and 524, and lower left/right sides 526 (in FIG. 3, the cold air discharge holes 52 defined in the central left side and the lower left side are covered by the cryogenic freezing compartment).

The shroud 56 is coupled to the rear portion of the grill fan 51 to define a predetermined space together with the grill fan 51. This space is a space in which the air cooled in the evaporator 77 provided in the rear surface of the grill fan assembly 50 or the shroud 56 is distributed. A cold air suction hole 58 communicating with a space defined at a rear side of the shroud 56 and a space between the grill fan 51 and the shroud 56 is defined in an approximately central upper portion of the shroud 56. Also, a fan 57 that suctions the cold air of the rear space of the shroud 56 through the cold air suction hole 58 to distribute and pressing the cold air into the space between the grill fan 51 and the shroud 56 is installed inside the cold air suction hole 58 in the space between the grill fan 51 and the shroud 56.

The cold air pressed by the fan 57 flows through the space between the grill fan 51 and the shroud 56 and then adequately distributed. Then, the cold air is discharged forward through the cold air discharge holes 52 that are opened forward.

A thermoelectric module accommodation part 53 in which a thermoelectric module assembly 100 for performing cryogenic cooling of the cryogenic freezing compartment 200 is installed is provided between the cold air discharge hole 522 defined in the right upper end and the cold air discharge hole 524 defined in the right central portion as the right upper portion of the grill fan 51.

The thermoelectric module accommodation part 53 is disposed on a front surface of the grill fan 51, which corresponds to a position at which the cryogenic freezing compartment 200 is installed, in the freezing compartment 40. The thermoelectric module accommodation part 53 may be installed in a manner in which the thermoelectric module accommodation part 53 is integrally molded with a wall defining a rear boundary of the freezing compartment 40 that is one of the storage space in which the cooling is performed by the refrigeration cycle cooling device 70, i.e., the grill fan 51 or separately manufactured with respect to the wall and then assembled with the wall. For example, the grill fan 51 may be manufactured through injection molding. Here, the grill fan 51 may be molded together with a portion corresponding to the thermoelectric module accommodation part 53. On the other hand, even when the rear boundary of the storage space may be defined by the inner case 12, and it is difficult to mold the thermoelectric module accommodation part 53 together while the inner case 12 is molded, as illustrated in FIG. 21, the thermoelectric module accommodation part 53 may be separately manufactured and then fixed to and assembled with the wall.

The thermoelectric module accommodation part 53 has an approximately rectangular parallelepiped shape (a rear side thereof is opened to the cooling chamber in which the evaporator is provided) extending to protrude forward from the front surface of the grill fan 51. When viewed from at a front side, this shape may have an approximately rectangular shape that is vertically long. When viewed from the front side, a grill part 531 through which the air cooled by the thermoelectric module assembly 100 is discharged is disposed at a central portion of the rectangular shape, and a suction part 533 that is opened forward is disposed on each of upper and lower portions of the rectangular shape. The suction part 533 may serve as a passage through which air outside the suction part 533 is suctioned into an inner space (that is a space defined at a rear side of the grill part 531 and an inner space of an outer circumferential wall of the rectangular shape defining an outer appearance of the thermoelectric module accommodation part 53) of the thermoelectric module accommodation part 53. The inner space of the thermoelectric module accommodation part 53 may communicate with a space defined at a front side rather than the thermoelectric module accommodation part 53 through the grill part 531 and the suction part 533 and be isolated from a space defined at a front side of the grill fan 51.

A discharge guide 532 having a partition wall shape extending forward between the grill part 531 and the suction part 533 is provided between the grill part 531 and the suction part 533 to prevent the cold air discharged from the grill part 531 from being immediately reintroduced into the suction part 533 that is adjacent thereto. To prevent the air discharged from the grill part 531 from being immediately reintroduced into the suction part 533, the discharge guide 532 may be disposed within only a range in which the grill part 531 and the suction part 533 are adjacent to each other.

However, when it is desired to further enhance an effect of the cold air discharged from the grill part 531 to flow forward, i.e., an effect of improving straightness, the discharge guide 532 may entirely surround the grill part 531 as illustrated in the drawings. Although the discharge guide 532 has a flow cross-section with a square shape as illustrated in the drawings, the discharge guide may have a flow cross-section with a circular shape like a shape of the grill part 531 or a blade of the fan disposed at the rear side of the grill part 531. The flow cross-sectional shape does not necessarily have a rectangular or circular flow cross-section, but may be modified into various shapes as long as it may improve the straightness of the cold air while preventing the cold air discharged from the grill part from being reintroduced into the suction part.

Also, the formed position of the suction part 533 is not limited to the upper and lower positions of the cooling fan 190. That is, the suction part may also be disposed at right and right sides of the cooling fan 190. The installed position thereof may be provided at one or more selected positions of the upper, lower, left, and right sides of the cooling fan 190.

The thermoelectric module accommodation part 53 has an opened rear side. Also, the thermoelectric module assembly 100 is inserted forward from the rear side of the grill fan 51 and is accommodated in the thermoelectric module accommodation part 53.

A sensor installation part, in which a sensor for detecting a temperature and humidity of the cryogenic freezing compartment 200 is installed, continuously installed at a side of the thermoelectric module accommodation part 53. A defrost sensor is installed on the sensor installation part 54 to detect a defrosting time of a cold sink that will be described later, thereby determining whether defrosting is required. The sensor installation part 54 may be disposed at a position that may represent a state of the cryogenic freezing space when the space of the cryogenic freezing space is measured.

According to an embodiment, since the suction part 533 is disposed at each of the upper and lower portions of the thermoelectric module accommodation part 53, it is advantageous for more accurate measurement that the sensor installation part 54 is installed to avoid the position. Thus, in this embodiment, the sensor installation part 54 may be installed on one side surface of the thermoelectric module accommodation part 53. Also, a through-hole is defined forward in the sensor installation part 54. Thus, an air atmosphere in the front of the sensor installation part may be transmitted to the inner space of the sensor installation part 54.

The thermoelectric module assembly 100 is inserted forward from the rear side of the grill fan assembly 50 and is accommodated into and fixed to the thermoelectric module accommodation part 53. In detail, an outer circumferential surface of the cooling fan 190 having a box fan shape is disposed to face an inner circumferential surface of the thermoelectric module accommodation part 53 at the front side of the thermoelectric module accommodation part 53, and in a state in which the position is restricted, the outer circumferential surface of the cooling fan 190 is fixed to a front surface of the thermoelectric module accommodation part 53 by using a fixing unit such as a screw. Also, the thermoelectric module assembly 100 is inserted forward from the rear side of the grill fan assembly 50 so as to be disposed at the rear side of the cooling fan 190 and then coupled and fixed to the grill fan assembly 50 by using the fixing unit such as the screw.

Although described below, a passage through which the refrigerant passes is provided in the heat sink 300 of the thermoelectric module assembly 100, and a refrigerant inflow tube 360 and a refrigerant outflow tube 370 through which the cold air is introduced and discharged are provided in the heat sink 300. While the refrigerator is assembled, the refrigerant inflow tube 360 and the refrigerant outflow tube 370 provided in the heat sink 300 of the thermoelectric module assembly 100 have to be welded to refrigerant tubes, through which the refrigerant flows, in the refrigeration cycle cooling device 70 of the refrigerator. Particularly, the inflow tube 360 may be connected to a rear end of the condenser, i.e., a rear side of an expansion device such as a liquid receiver and a capillary tube, and the outflow tube 370 may be connected to a front side of the evaporator.

Figure 13:
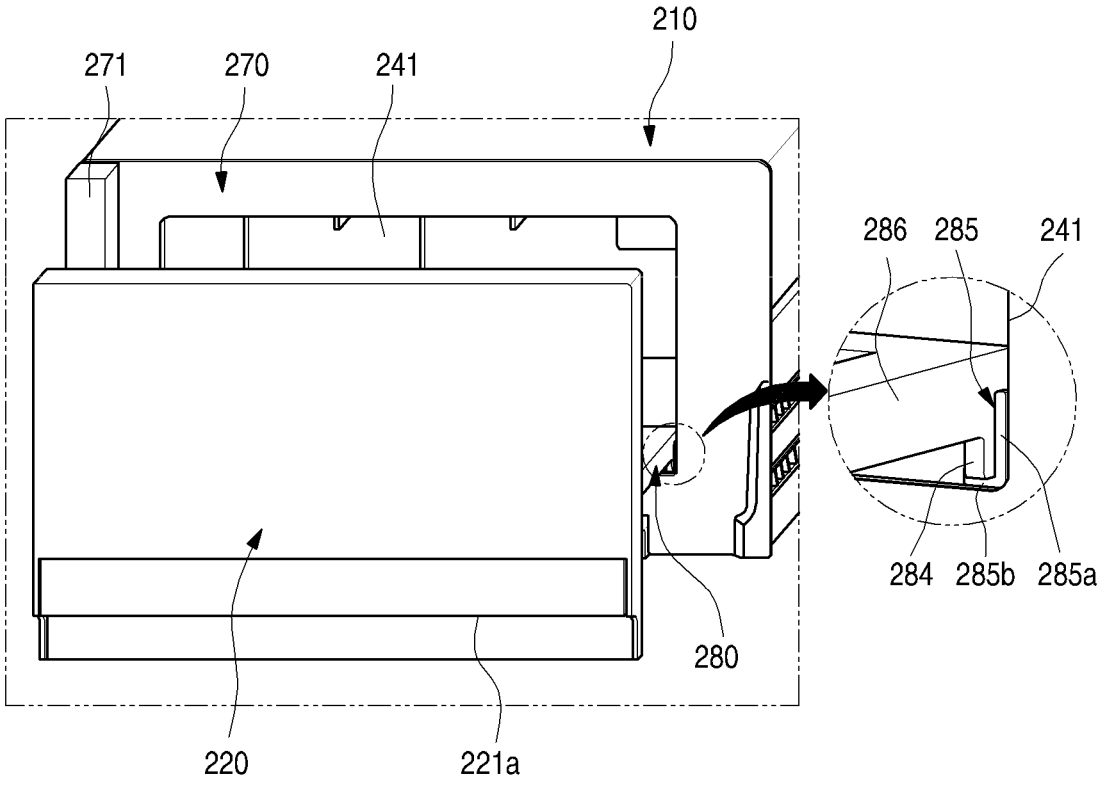
FIG. 13 is a view illustrating a contact state of a spacer of the cryogenic freezing compartment.

As described above, the thermoelectric module assembly 100 is fixed to be spaced a predetermined distance from the inner case 12 through a housing support 111 in the form of a module in which components (the cold sink, the thermoelectric module, the heat sink, and a module housing) illustrated in FIG. 13 are assembled. Thus, a worker may more easily perform the welding operation in the space that is secured by the housing support 111, and after the welding of the refrigerant tube is finished, the grill fan assembly 50 is installed at a rear side of the freezing compartment to fix the grill fan assembly 50 to the thermoelectric module assembly 100. The housing support 111 is fixed to the inner case 12 through a screw or is fixed to the inner case 12 in a manner in which a protrusion protruding from the inner case 12 is fitted into a hole defined in a rear portion of the housing support 111.

Figure 5:
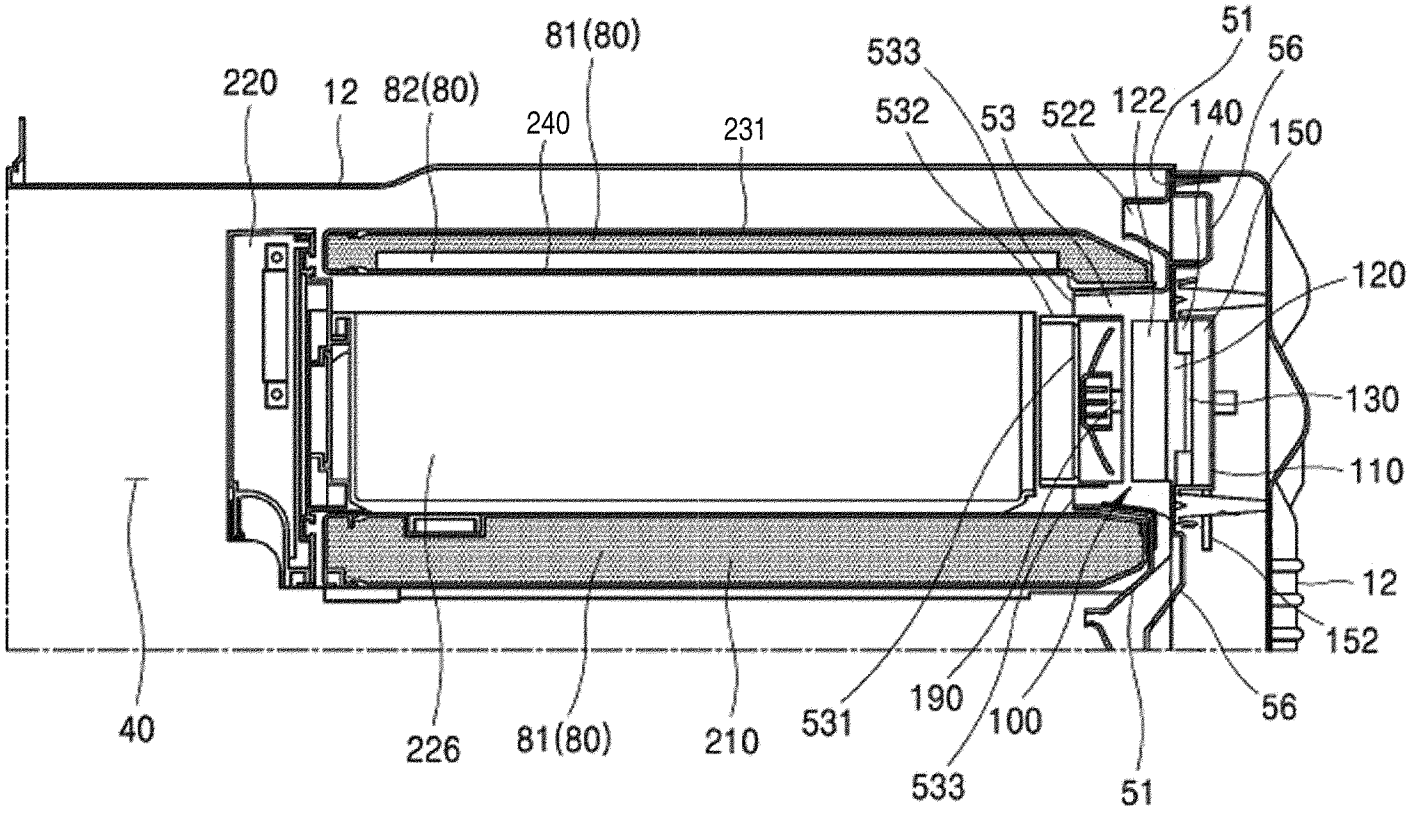
FIG. 5 is a cross-sectional view taken along line 5-5' of FIG. 2.

FIG. 5 is a cross-sectional view taken along line 5-5' of FIG. 2.

As illustrated in FIG. 5, a cryogenic case 210 has an opened front side, and an opening 211 is defined in a portion of a rear portion of the cryogenic case 210. As a result, the cryogenic case 210 has a box shape having an approximately parallelepiped shape, and a rail structure extending in a front and rear direction is provided on left and right surfaces and then fixedly mounted on the inside of the refrigerator.

The cryogenic case 210 includes an outer case 230 facing the space of the freezing compartment 40 and an inside case 240 disposed inside the outer case 230 and coupled to the outer case 230 to define a predetermined space between the outer case 230 and the inside case 240. The insulation material 80 is disposed in the space between the outer case 230 and the inside case 240 to thermally insulate the inner space of the cryogenic freezing compartment and the freezing compartment 40. A foamed insulation material 81 such as polyurethane may be used as the insulation material. The foamed insulation material is configured to fix the outer case 230 to the inside case 240 in addition to the insulation function. A vacuum insulated panel 82 having better insulation efficiency may be further applied to the wall of the cryogenic case 210 that has to have a thin thickness.

The opened front side of the cryogenic case 210 is opened and closed by a case door 220. The case door 220 has a predetermined space. Also, an insulation material is provided in the space to thermally insulate the inner space of the cryogenic freezing compartment 200 from the space of the freezing compartment 40. The case door 220 may have a predetermined thickness for user's gripping feeling, and the foamed insulation material may be foamed into a hollow to securer rigidity.

A cryogenic accommodation member 226 accommodated into the inner space of the cryogenic case 210 is seated at the rear side of the case door 220. The cryogenic accommodation member 226 may be integrally behaved with the case door 220. When the case door 220 is withdrawn forward, the cryogenic accommodation member 226 is slidably withdrawn forward from the cryogenic case 210. The case door 220 is guided by an external rail disposed on a lower or bottom surface of the cryogenic case 210 to slidably move forward and backward.

A portion of a rear wall of the cryogenic accommodation member 226 may be opened so that the cold air that is cryogenically cooled in the thermoelectric module assembly 100 is introduced into the cryogenic accommodation member 226 when the cold air flows forward by the cooling fan 190. Thus, when the cryogenic freezing compartment 200 is installed in the freezing compartment 40, since the opened rear surface of the cryogenic accommodation member 226 faces the thermoelectric module accommodation part 53, the cryogenic cold air supplied to the front side by the cooling fan 190 from the thermoelectric module accommodation part 53 may be smoothly introduced into the inner space of the cryogenic accommodation member 226.

The cryogenic case 210 has a top surface that is slightly spaced apart from a bottom surface of an upper member of the inner case 12, i.e., a ceiling surface. According to an embodiment, the top surface of the cryogenic case 210 and the bottom surface of the upper member of the inner case 12 may cooperate with each other to realize a duct-like structure. Thus, the air discharged from the cold air discharge hole 522 defined in the upper end of the grill fan 51 may be guided forward along the duct-like structure to smoothly flow. Thus, even though the cryogenic case 210 is installed, the cold air may smoothly reach the door basket 27 installed in the inner upper portion of the freezing compartment door 22.

To realize the above-described duct-like structure, an upper wall of the cryogenic case 210 has to have a thin thickness. That is, when the upper portion of the cryogenic case 210 has a thin thickness, the duct-like structure may be realized while securing an inner volume of the cryogenic case. In this respect, according to an embodiment, the foamed insulation material 81 may be foamed in a remaining space in state in which the vacuum insulated panel 82 is built in the upper member of the cryogenic case 210 so that the upper member of the cryogenic case 210 has the thin thickness. The foamed insulation material may be filled into the inner spaces of the outer case and the inside case 240, which are not filled by the vacuum insulated panel 82. Thus, coupling force between the outer case 230 and the inside case 240 may be improved in addition to the insulation performance.

Furthermore, since the cold air discharge hole 524 that is disposed in the vicinity of the middle height of the grill fan 51 is disposed in the lower portion of the cryogenic case 210, the discharged cold air may smoothly flow forward.

The thermoelectric module assembly 100 is an assembly in which the cold sink 120, the thermoelectric module 130, the insulation material 140, and the heat sink 300 are stacked and installed in the module housing 110 to form a module shape. The cold sink 120, the thermoelectric module 130, the insulation material 140, and the heat sink 300 are inserted into and fixed to an accommodation groove 113 of the module housing 110 in the state in which the cold sink 120, the thermoelectric module 130, the insulation material 140, and the heat sink 300 are closely attached and stacked by a closely attaching unit such as the screw.

Also, the thermoelectric module assembly 100 may be mounted in a manner in which the module housing 110 is closely attached and fixed to a rear surface of the grill fan assembly 50. A specific structure of the thermoelectric module assembly 100 will be described below in more detail.

Figure 6:
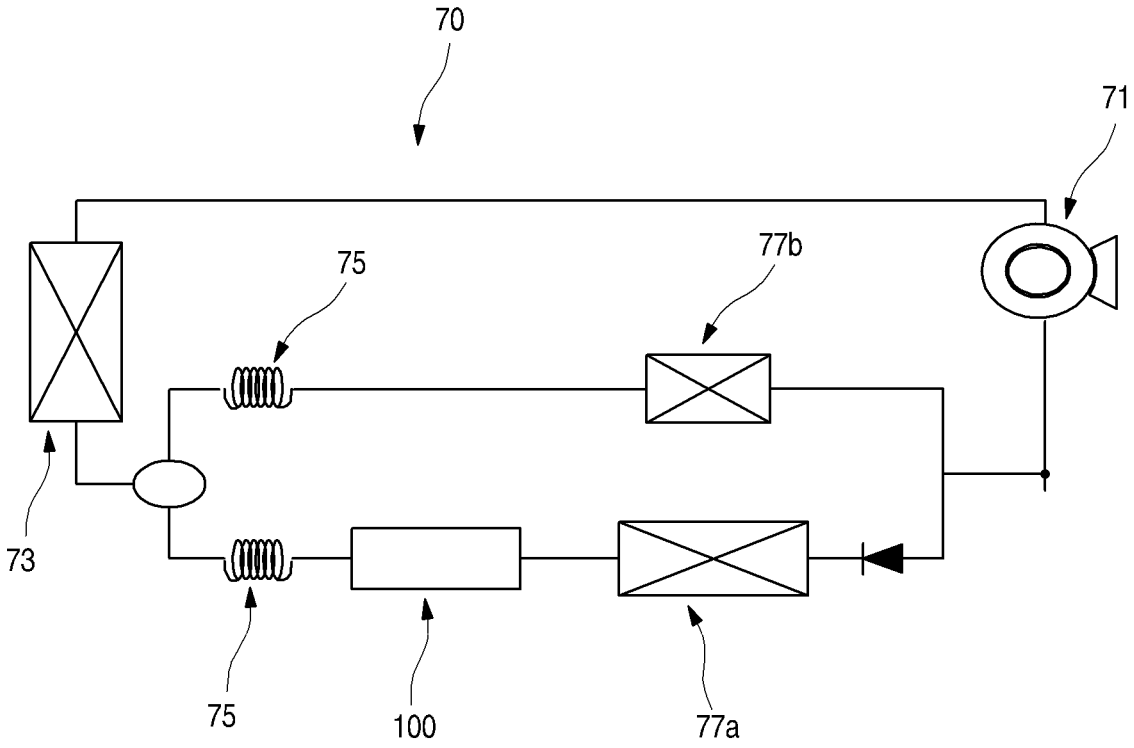
FIG. 6 is a schematic view illustrating a configuration of a refrigeration cycle cooling device of the refrigerator.

FIG. 6 is a schematic view illustrating a configuration of the refrigeration cycle cooling device of the refrigerator.

The refrigeration cycle cooling device 70 of the refrigerator according to an embodiment is a device for discharging heat inside the freezing compartment to the outside through the refrigerant passing through a thermodynamic cycle of evaporation, compression, condensation and expansion. The refrigeration cycle cooling device according to an embodiment includes an evaporator 77 in which a liquid refrigerant in a low-pressure atmosphere is evaporated by heat exchange with air in the cooling chamber (a space between the grill fan assembly and the inner housing), a compressor 71 for pressing a gas refrigerant vaporized in the evaporator and discharging a high-temperature high-pressure gas refrigerant, a condenser 73 for condensing the high-temperature high-pressure gas refrigerant discharged from the compressor 71 by heat exchange with air in the outside (machine room) of the refrigerator to discharge heat, and an expansion device 75 such as a capillary tube, which drops down a pressure of the refrigerant condensed in the condenser 73 to a low temperature atmosphere. The low-temperature low-pressure liquid refrigerant that decreases in pressure in the expansion device 75 is reintroduced into the evaporator 77.

According to an embodiment, since heat of the heat sink 300 of the thermoelectric module assembly 100 has to be quickly cooled, the low-temperature low-pressure liquid refrigerant that decreases in pressure and temperature after passing through the expansion device 75 has to pass through the heat sink 300 of the thermoelectric module assembly 100 before being introduced into the evaporator 77.

Thus, the refrigerant discharged via the capillary tube is introduced into the heat sink 300 through the refrigerant inflow tube 360 to cool or absorb heat generated from a heat generation surface of the thermoelectric module 130 and then is discharged from the refrigerant outflow tube 370 and reintroduced into the evaporator 77.

The liquid refrigerant may quickly absorb the heat generated from the heat generation surface 130*b* of the thermoelectric module 130 through a thermal conductive manner using the heat sink 300 while passing through the heat sink 300. Thus, the heat of the heat sink 300 may be quickly cooled by the refrigerant circulating through the heat sink 300.

In detail, the compressor 71 presses the low-temperature low-pressure gas refrigerant to discharge the high-temperature high-pressure gas refrigerant. Also, the refrigerant is condensed, i.e., liquefied while releasing the heat in the condenser 73. As described above, the compressor 71 and the condenser 73 are disposed in the machine room of the refrigerator.

The high-temperature high-pressure liquid refrigerant that is liquified by passing through the condenser 73 may be introduced into the evaporator 77 in the depressurized state by passing the expansion device 75 such as the capillary tube. In the evaporator 77, the refrigerant is evaporated while absorbing heat therearound. According to the embodiment of FIG. 6, the refrigerant passing through the condenser 73 is branched into a refrigerating compartment-side evaporator 77*b* or a freezing compartment-side evaporator 77*a*. Here, the heat sink 300 of the thermoelectric module assembly 100 is disposed at the front side of the freezing compartment-side evaporator 77*a* and disposed at the rear side of the expansion device 75 in the refrigerant flow path.

The cryogenic freezing compartment is a space in which a maximum freezing temperature of a temperature of about −50 degrees Celsius is to be maintained. Thus, when the heat generation surface 130*b* of the thermoelectric module 130 is maintained in a very cool state, the heat absorption surface 130*a* may be easily maintained in a colder state. Thus, a portion of the heat sink 300 through which the refrigerant flows may be disposed at the front side rather than the freezing compartment-side evaporator 77*a* in the refrigerant flow path and thus be maintained in the colder state. Particularly, since the heat sink 300 comes into direct contact with the thermoelectric module 130 to absorb heat from the thermoelectric module 130 in the conductive manner through a heat conductor such as metal, the heat generation surface 130*b* of the thermoelectric module 130 may be surely cooled.

Also, while the cooling of the cryogenic freezing compartment 200 is performed, i.e., the refrigerant within the heat sink 150 cools the heat generation surface 130*b* of the thermoelectric module 130, the compressor may operate at a maximum output or an output higher than a set output to prevent the cooling efficiency of the freezing compartment from being deteriorated.

When the cryogenic freezing compartment 200 is to be used at a temperature of about −20 degrees Celsius as in the normal freezing compartment without being cooled to a cryogenic temperature of about −50 degree Celsius, it is possible to be used as a general freezing compartment only by not supplying power to the thermoelectric module 130. In this case, if power is not applied to the thermoelectric module 130, the heat absorption and the heat generation do not occur in the heat sink of the thermoelectric module 130. Thus, the refrigerant passing through the heat sink 300 is introduced into the freezing compartment-side evaporator 77*a* in the liquid refrigerant state that is not evaporated because of not absorbing heat.

That is, the cold air generated in the refrigerant cycle cooling device through the general compression manner may be supplied to the freezing compartment 40 and the refrigerating compartment 30 of the refrigerator. When the cryogenic freezing compartment operates, the refrigerant passing through the expansion device 75 may quickly absorb heat generated from the heat generation surface of the thermoelectric device 130 by passing through the heat sink 300 of the thermoelectric module assembly 100 so that the heat generated from the heat generation surface of the thermoelectric module 130 is quickly discharged and then is introduced into the evaporator 77*a*.

Although the refrigeration cycle cooling device 70 in which the evaporators 77*a* and 77*b* are provided in plurality to individually cool the refrigerating compartment 30 and the freezing compartment 40 is described as an example in this embodiment, the embodiment may be equally applied to a refrigeration cycle cooling device in which all the refrigerating compartment 30 and the freezing compartment 40 are cooled by using one evaporator 77*a*.

Hereinafter, a structure of the thermoelectric module assembly 100 will be described in more detail.

Figure 7:
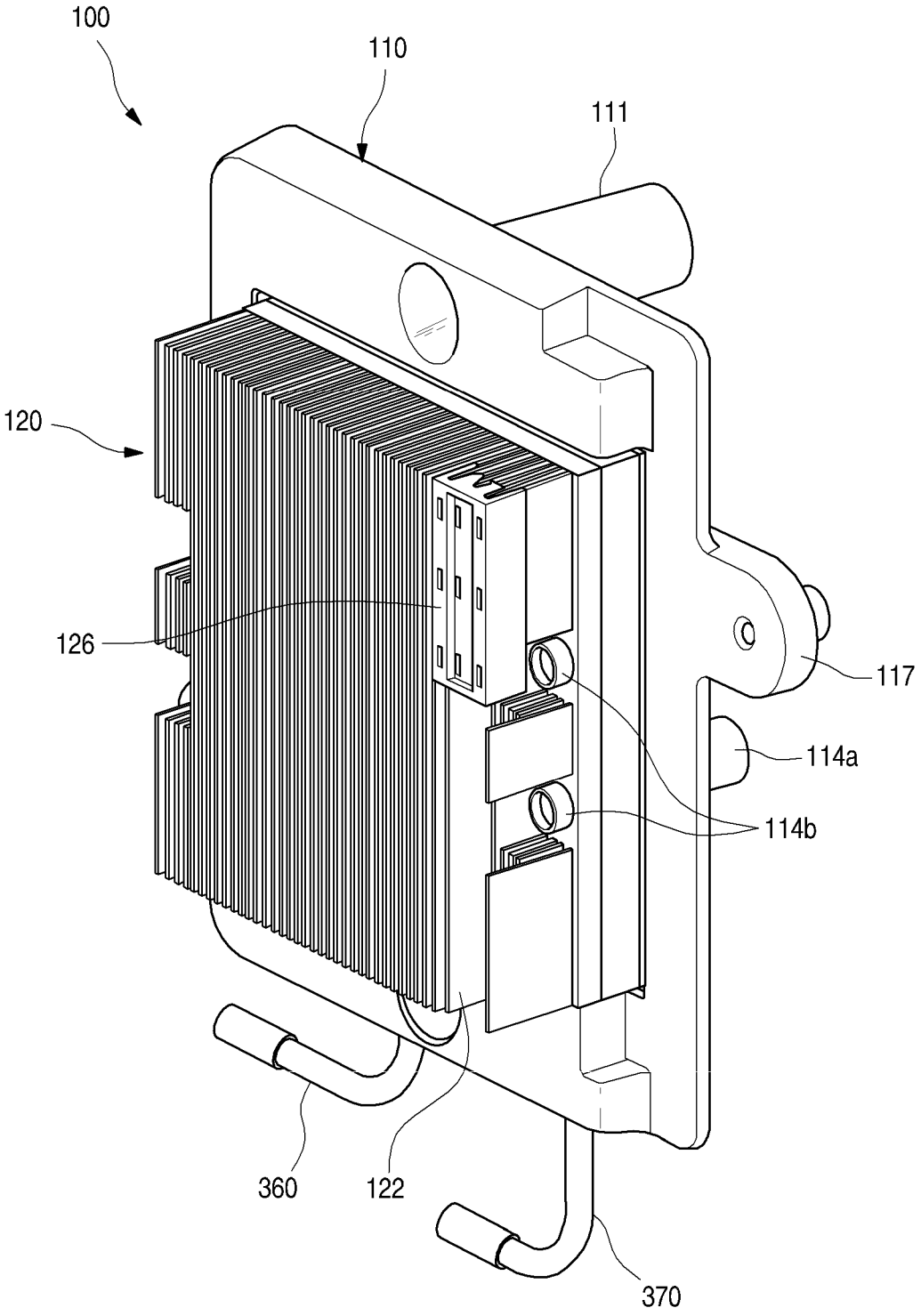
FIG. 7 is a front perspective view of the thermoelectric module assembly.
Figure 8:
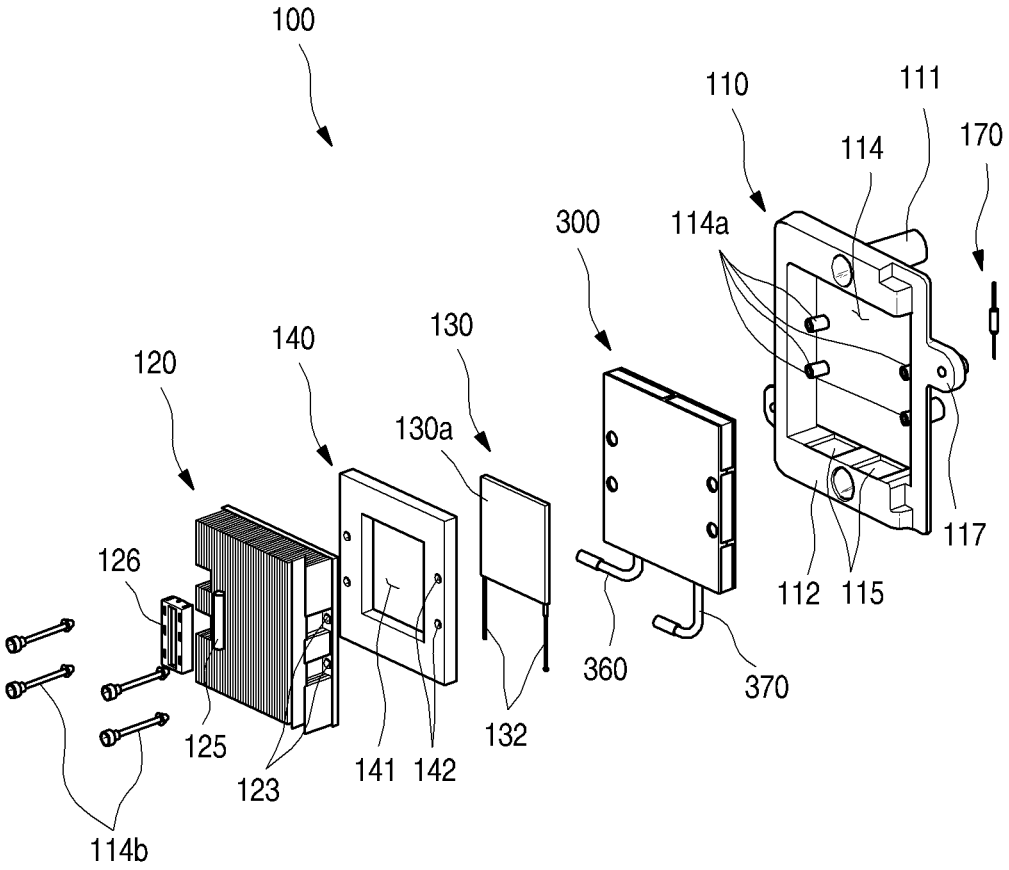
FIG. 8 is an exploded front perspective view illustrating a coupling structure of the thermoelectric module assembly.

FIG. 7 is a front perspective view of the thermoelectric module assembly, and FIG. 8 is an exploded front perspective view illustrating a coupling structure of the thermoelectric module assembly.

As illustrated in the drawings, a thermoelectric module assembly 100 according to another embodiment may include a thermoelectric module 130, a cold sink 120, a heat sink 300, an insulation material 140, and a module housing 110.

The thermoelectric module 130 is a device using a Peltier effect. The Peltier effect refers to a phenomenon in which, when a DC voltage is applied to both ends of two different elements, heat is absorbed into one side, and heat is generated from the other side according to a direction of current.

The thermoelectric module has a structure in which an n-type semiconductor material, in which electrons are the main carriers, and a p-type semiconducting material, in which holes are carriers, are alternately connected in series. Here, an electrode portion for allowing current to flow from the p-type semiconductor material to the n-type semiconductor material is disposed on a first surface, and an electrode portion for allowing current to flow from the n-type semiconductor material to the p-type semiconductor material with reference to any one direction in which the current flows. Thus, when the current is supplied in a first direction, the first surface becomes the heat absorption surface, and the second surface becomes the heat generation surface. When the current is supplied in a second direction opposite to the first direction, the first surface becomes the heat generation surface, and the surface becomes a heat absorption surface.

According to an embodiment, the thermoelectric module assembly 100 is inserted and fixed forward from the rear side of the grill fan assembly 50, and the cryogenic freezing compartment 200 is provided at the front side of the thermoelement module assembly 100. Thus, the heat absorption occurs on a surface facing a surface defining a front side of the thermoelectric module, i.e., a surface facing the cryogenic freezing compartment 200, and the heat generation occurs on a surface defining a rear side of the thermoelectric module, i.e., a surface having a backdrop of the cryogenic freezing compartment 200 or in a direction facing the cryogenic freezing compartment 200. Also, when current is supplied in the first direction in which the heat absorption occurs on the surface facing the cryogenic freezing compartment in the thermoelectric module, and the heat generation occurs on the opposite surface, the freezing of the cryogenic freezing compartment may be enabled.

In an embodiment, the thermoelectric module 130 has a flat plate shape having a front surface and a rear surface. Here, the front surface may be a heat absorption surface 130*a*, and the rear surface may be a heat generation surface 130*b*. The DC power supplied to the thermoelectric module 130 generates the Peltier effect. Thus, heat of the heat absorption surface 130*a* of the thermoelectric module 130 moves to the heat generation surface 130*a*. Thus, the front surface of the thermoelectric module 130 becomes a cold surface, and the rear surface becomes a heat generation portion. That is, it may be said that the heat within the cryogenic freezing compartment 200 is discharged to the outside of the cryogenic freezing compartment 200. The power supplied to the thermoelectric module 130 is applied to the thermoelectric module through a leading wire 132 provided in the thermoelectric module 130.

The cold sink 120 may come into contact with and be stacked on the front surface of the thermoelectric module 130, i.e., the heat absorption surface 130*a* facing the cryogenic freezing compartment 200. The cold sink 120 may be made of a metal material or an alloy material such as aluminum having high terminal conductivity. A plurality of heat exchange fins 122, each of which has a shape extending vertically, are disposed to be horizontally spaced apart from each other on the front surface of the cold sink 120.

The heat sink 300 may come into contact with and stacked on a rear surface of the thermoelectric module 130, i.e., the heat generation surface 130*b* facing the direction in which the cryogenic freezing compartment 200 is disposed. The heat sink 300 is configured to quickly dissipate or discharge the heat generated from the heat generation surface 130*b* by using the Pelitier effect. A portion corresponding to the evaporator 77 of the refrigeration cycle cooling device 70 used for the cooling of the refrigerator may be constituted by the heat sink 300. That is, when a process in which the low-temperature low-pressure liquid refrigerant passing through the expansion device 75 in the refrigeration cycle absorbs heat or a process in which the refrigerant absorbs heat and then is evaporated occurs in the heat sink 300, the refrigerant absorbs the heat generated from the heat generation surface 130*b* of the thermoelectric module 130, or the refrigerant absorbs the heat and then is evaporated to very immediately cool the heat of the heat generation surface 130*b*.

Since the cold sink 120 and the heat sink 300 are stacked on each other with the thermoelectric module 130 having a flat shape therebetween, it is necessary to isolate heat therebetween. Thus, the insulation material 140 surrounding the thermoelectric module 130 and filled into a gap between the cold sink 120 and the heat sink 300 is stacked on the thermoelectric module assembly 100. That is, the cold sink 120 has an area greater than that of the thermoelectric module 130 and also has substantially the same area as the thermoelectric module 130 and the insulation material 140. Similarly, the heat sink 300 has an area greater than that of the thermoelectric module 130 and also has substantially the same area as the thermoelectric module 130 and the insulation material 140.

It is not necessary that the cold sink 120 has the same size as the heat sink 300. That is, the heat sink 300 may have a size greater than that of the cold sink 120 to effectively discharge heat.

According to an embodiment, the refrigerant of the refrigeration cycle cooling device 70 flows through the heat sink so that the heat discharge efficiency of the heat sink 300 is instantly and reliably caused, and the refrigerant flow path is disposed over an entire area of the heat sink so that the refrigerant is evaporated in the heat sink to quickly absorb the heat from the heat generation surface of the thermoelectric module 130 as the heat of vaporization. That is, the heat sink 300 according to an embodiment is designed to have a size enough to immediately absorb and discharge the heat generated by the thermoelectric module 130, and the cold sink 120 has a size less than that of the heat sink 300. However, according to an embodiment, it should be noted that the size of the cold sink 120 increase by considering the fact that the heat sink 130 is heat-exchanged between liquid and solid, whereas the cold sink 120 is heat-exchanged between gas and solid, so that the heat exchange efficiency at the cold sink 120 further increases. As described, in a degree of the enlarged size of the cold sink 120, although the cold sink 120 is designed to have a size corresponding to the heat sink 130 in consideration of compactness of the thermoelectric module assembly 100 according to an embodiment, the cold sink 120 may have a size greater than that of the heat sink 130 to more improve the heat exchange efficiency at the cold sink 120.

The module housing 110 is configured to accommodate the thermoelectric module assembly 100 and is fixedly mounted on the grill fan assembly 50 so that the thermoelement module assembly 100 is fixedly mounted and effectively supplies the cold air to the cryogenic freezing compartment.

The module housing 110 has an accommodation groove 114. The accommodation groove 114 may provide a space for accommodating the components constituting the thermoelectric module assembly 100. The accommodation groove 114 may be opened to the cryogenic freezing compartment 200 and have a front surface that is sealed by mounting the thermoelectric module assembly 100 on the grill fan assembly 50. Thus, the cold air generated in the cold sink 120 may be effectively supplied into the cryogenic freezing compartment, and the heat sink 300 may be heat-exchanged by the evaporator 77 without having an influence on temperature of the inside of the refrigerator and the cryogenic freezing compartment 200.

Also, a fixing boss 114*a* may be disposed inside the accommodation groove 114. The fixing boss 114*a* may extend to pass through the heat sink 300, the insulation material 140, and the cold sink 120. An opening is defined in an extending end of the fixing boss 114*a*, and the fixing boss 114*a* has a hollow therein so that the fixing member 114*b* passing through the cold sink 120 is coupled to the opening of the fixing boss 114*a*. Here, the fixing member 114*b* may include a screw, a bolt, or a corresponding constituent, which is coupled to the fixing boss 114*a*.

Also, an edge hole 115 through which the refrigerant inflow tube 360 and the refrigerant outflow tube 370 pass may be further defined in an edge of the accommodation groove 114. The edge hole 115 may be provided in a pair so that the leading wire 132 of the thermoelectric module 130 is accessible together with the refrigerant inflow tube 360 and the refrigerant outflow tube 370. Also, the edge hole 115 may be provided so that at least a portion of a bottom surface of a circumference of the accommodation groove 114 is opened. Here, the at least a portion may be opened to the evaporator 77. Thus, the refrigerant inflow tube 360 and the refrigerant outflow tube 370 may be easily connected to each other at a position that is adjacent to the evaporator 77.

A flange 112 is disposed on a circumference of an opened end of the accommodation groove 114. The flange 112 may be coupled to the shroud 56 and the grill fan 51 in a closely attached state. The flange 112 prevents the cold air from leaking through surface contact with the shroud 56 or the grill fan 51 and also allows the front surface of the thermoelectric module assembly 100 to be stably seated and supported on the grill fan assembly 50.

A housing coupling part 117 may be disposed on each of both sides of the flange 112. The housing coupling part 117 may be coupled to one side of the grill fan 51 or the shroud 56 by using the coupling member such as the screw. The module housing 110 may be fixedly mounted on the grill fan assembly 50. The module housing 110 may be closely attached to the grill fan assembly 50 to prevent the cold air of the thermoelectric module assembly 100 and the cryogenic freezing compartment 200 from leaking through the contact portion between the flange 112 and the grill fan assembly 50.

The housing support 111 extending backward, i.e., toward the inner case 12 may be disposed on the rear surface of the grill fan 51. The housing support 111 may support the module housing 110 to be maintained in a state spaced apart from the inner case 12.

The heat sink 300 may be accommodated inside the module housing 110, and then, the insulation material 140 may be stacked. The insulation material 140 may have a rectangular frame shape, and the thermoelectric module 130 may be disposed in the insulation material 140. Also, both surfaces of the thermoelectric module 130 may come into contact with the heat sink 300 and the cold sink 120. When power is applied, the heat sink 300 generates heat, and the cold sink 120 absorbs the heat.

After the insulation material 140 is stacked, the cold sink 120 may be mounted. The cold sink 120 may have a front surface having a size corresponding to the opened size of the accommodation groove 114 to cover the opened surface of the accommodation groove 114.

Also, a module contact part 124 inserted into a thermoelectric module accommodation hole 141 defined in a center of the insulation material 140 may be disposed at a center of the rear surface of the cold sink 120. The module contact part 124 has a size corresponding to the thermoelectric module accommodation hole 141 to seal the inside of the insulation material 140 and come into contact with the heat absorption surface 130*a* of the thermoelectric module 130 and then is cooled.

A case door material may be coupled to the coupling holes 123 defined in both sides of the cold sink 120, and thus, the cold sink 120 is coupled to the module housing 110 so that the module contact part 124 of the cold sink 120 is maintained to be closely attached to the heat absorption surface 130*a* of the thermoelectric module 130.

A temperature sensor 125 for detecting a temperature of the cold sink 120 may be disposed on one side of the front surface of the cold sink 120. The temperature sensor 125 may be fixedly mounted on one side of the heat exchange fin 122 by a sensor bracket 126.

The temperature sensor 125 may detect a temperature of the cold sink 120 to control an operation of the thermoelectric module 130. For example, the temperature sensor prevents the temperature of the cold sink 120 from increasing above a set temperature and being overheated when a reverse voltage is applied to the thermoelectric module 130 when a defrosting operation of the cryogenic freezing compartment 200 is performed.

Figure 9:
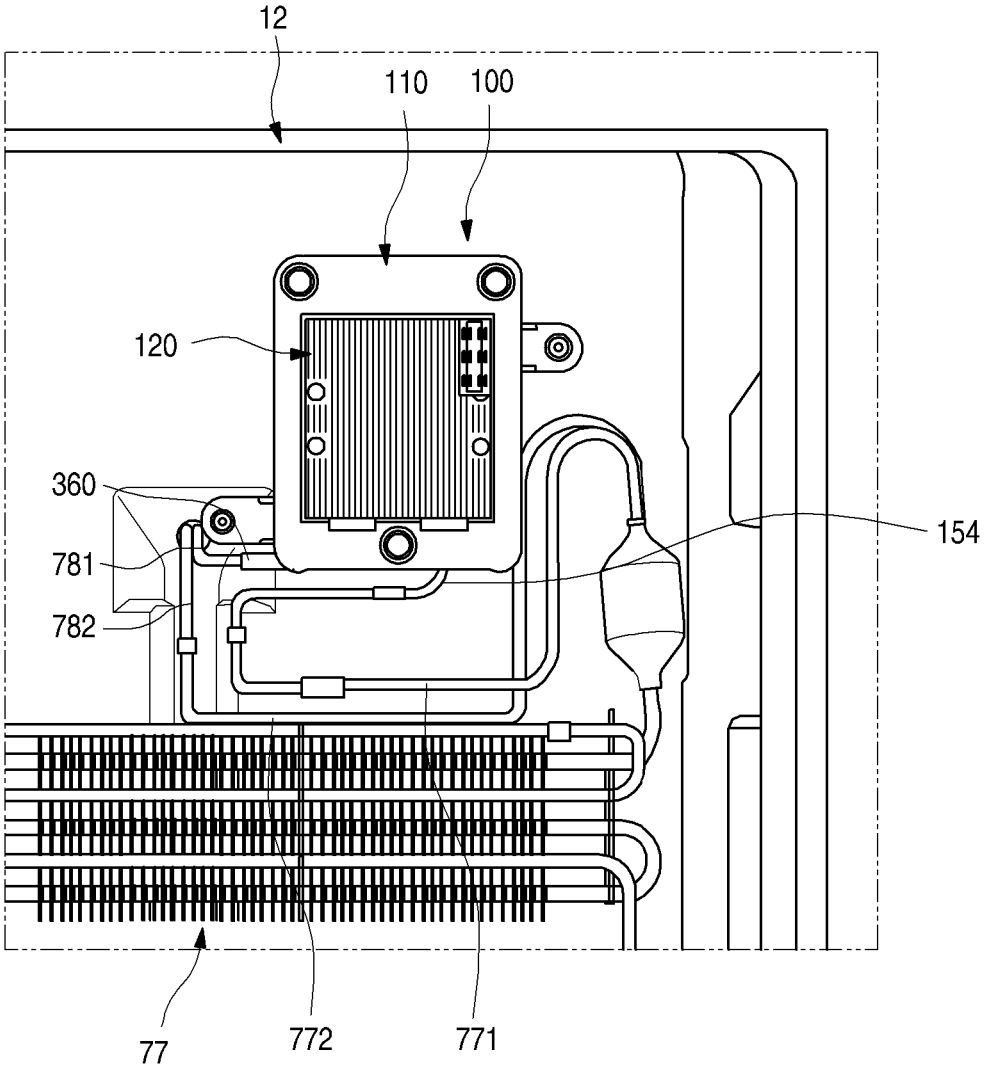
FIG. 9 is a view illustrating a connection state of the thermoelectric module assembly, the evaporator, and the refrigerant tube.

FIG. 9 is a view illustrating a connection state of the thermoelectric module assembly, the evaporator, and the refrigerant tube.

As illustrated in the drawings, the heat sink 300 of the thermoelectric module assembly 100 may be cooled by using the low-temperature refrigerant introduced into the evaporator 88. That is, to cool the heat generation surface 130*b* of the thermoelectric module 130, a portion of the refrigerant tube introduced into the evaporator 77 may be bypassed to be introduced into the heat sink 300.

In detail, the evaporator 77 may be mounted between the inner case 12 and the grill fan assembly 50. Also, the thermoelectric module assembly 100 may be fixedly mounted on the grill fan assembly 50 and the inner case 12 and be disposed above the evaporator 77.

Here, the thermoelectric module assembly 100 may be disposed on one side that is adjacent to the distal tube of the evaporator 77 of both left and right sides of the evaporator 77 so that the evaporator 77 and the tube assembly 78 are easily connected to each other. That is, the evaporator input tube 771 through which the refrigerant is introduced into the evaporator 77 may be disposed adjacent to an end of an evaporator output tube 772.

As described above, the thermoelectric module 130, the evaporator 77, and the tube assemblies 78 may be more easily connected to each other through the disposition structure of the thermoelectric module assembly 100 and the coupling structure of the module housing 110.

Also, the refrigerant inflow tube 360 and the refrigerant outflow tube 370 may be bent to the evaporator input tube 771 and the evaporator output tube 772 so that the evaporator input tube 771 and the evaporator output tube 772 of the evaporator 77 are easily connected to each other.

The tube assembly 78 may be disposed outside the inner case 12, i.e., on a rear wall of the refrigerant main body 10. The tube assembly 78 includes a compressor connection part 783 connected to the compressor 71, a capillary tube 781 connected to the evaporator input tube 771, and an output connection part 782 connected to the evaporator output tube 772.

In the state in which the evaporator 77 and the thermoelectric module assembly 100 are fixedly mounted, the refrigerant inflow tube 360 of the thermoelectric module assembly 100 may be connected to the capillary tube 781 through the welding, and the refrigerant outflow tube 370 may be connected to the evaporator input tube 771 through the welding. Also, the evaporator output tube 772 may be connected to the output connection part 782 of the tube assembly 78 through the welding.

In the flow path of the refrigerant according to the connection structure of the tubes, the low-temperature refrigerant introduced through the capillary tube 781 may pass through the heat sink 300 to cool the heat generation surface 130*b* of the thermoelectric module 130 coming into contact with the heat sink 300. Also, the refrigerant heat-exchanged by passing through the evaporator 77 through the evaporator input tube 771 may be introduced into the tube assembly 78 through the evaporator output tube 772 and the output connection part 782 and then be supplied to the compressor 71 along the compressor connection part 783 of the tube assembly 78.

As described above, the heat sink 300 may be effectively cooled by bypassing the low-temperature refrigerant introduced into the evaporator 77.

The heat absorption surface 130*a* of the thermoelectric module 130 may be in the extremely low-temperature state through the cooling of the heat generation surface 130*b* by the heat sink 300, Here, a temperature difference between the heat absorption surface 130*a* and the heat generation surface 130*b* may be about 30° C. or more so that the inside of the cryogenic freezing compartment 200 is cooled to an extremely low temperature of about −40° C. to about −50° C.

Hereinafter, a structure of the cryogenic freezing compartment according to an embodiment will be described in more detail.

Figure 10:
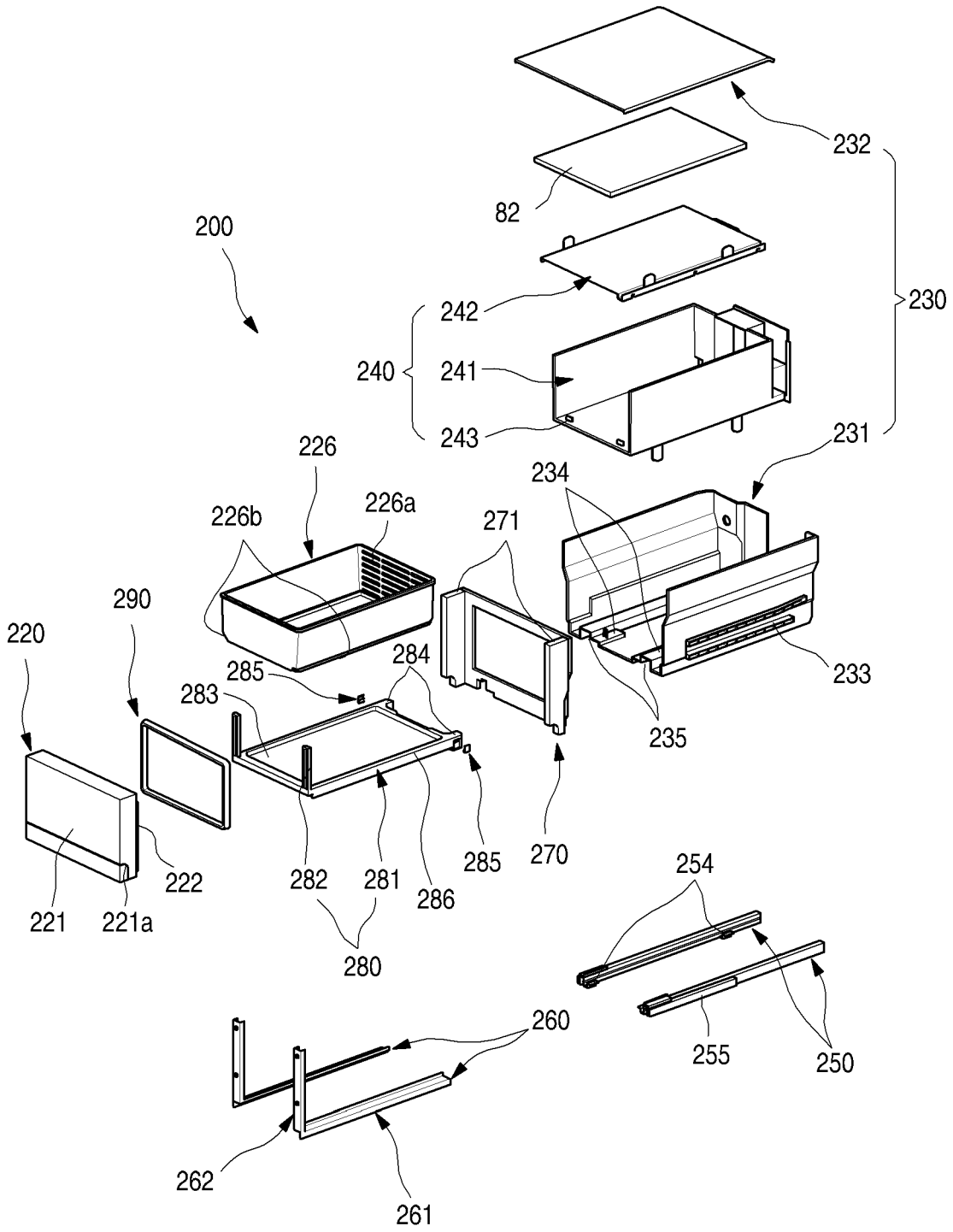
FIG. 10 is an exploded perspective view of the cryogenic freezing compartment.
Figure 11:
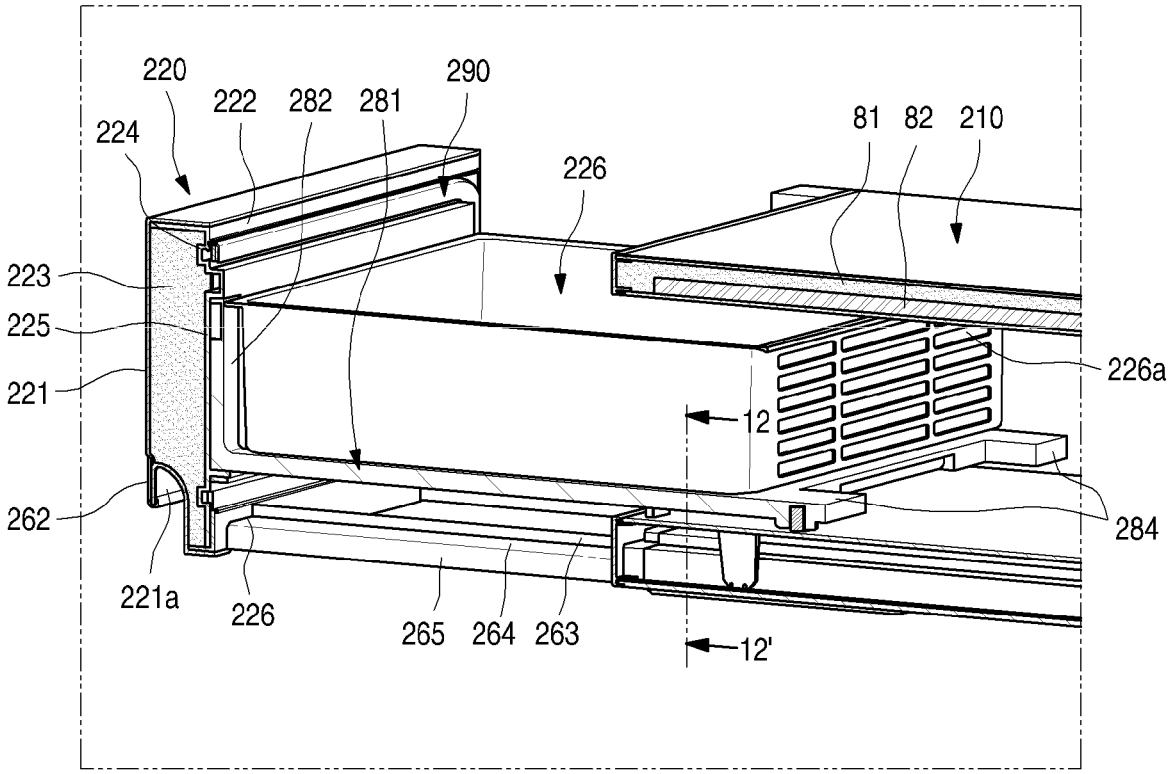
FIG. 11 is a cross-sectional view taken along line 11-11' of FIG. 3 in a state in which the cryogenic freezing compartment is opened.

FIG. 10 is an exploded perspective view of the cryogenic freezing compartment. Also, FIG. 11 is a cross-sectional view taken along line 11-11' of FIG. 3 in a state in which the cryogenic freezing compartment is opened.

As illustrated in the drawings, the cryogenic freezing compartment according to an embodiment may include a cryogenic case 210 defining an entire storage pace and a case door 220 opening and closing the cryogenic case 210.

A front surface of the cryogenic case 210 may be opened and also be opened and closed by the case door 220. Also, a rear surface of the cryogenic case 210 may also be opened, and the thermoelectric module accommodation part 53 may be inserted into the opening. Thus, in the state in which the case door 220 is closed, cold air may be supplied into an inner space of the cryogenic case 210, and the cryogenic freezing compartment 200 may be cooled in a cryogenic state.

In more detailed structure of the cryogenic case 210, the cryogenic case 210 may include an outer case 230 defining an outer appearance, an inside case 240 disposed inside the outer case, and a foamed insulation material filled between the outer case 230 and the inside case 240.

The inside case 240 may include an inside case body 241 having an opened top surface and an inside case cover 242 covering the opened top surface of the inside case body 241. Also, the outer case 230 may include the outer case body 231 having opened top surface and an outer case cover 232 covering the opened top surface of the outer case body 231.

The foamed insulation material 81 may be filled between the inside case cover 242 and the outer case cover 232, and a vacuum insulated panel 82 may be further provided between the inside case cover 242 and the outer case cover 232. In the case of the vacuum insulated panel 82, a thickness of the top surface of the cryogenic case 210 may be minimized. Therefore, an upper space of the cryogenic case 210 may be secured, and a space through which the cold air supplied to the freezing compartment 40 flows through the upper space of the cryogenic case 210 may be secured.

A case mounting part 233 for mounting the cryogenic case 210 to the inside of the freezing compartment 40 may be disposed on outer surface of the outer case 230. The case mounting part 233 may extend forward and backward and thus be mounted or separated while the cryogenic case 210 moves forward and backward. As illustrated in FIG. 2, a rear surface of the cryogenic case 210 may be closely attached to the grill fan assembly 50 in the state of being mounted and be fixed and mounted on the inner surface of the inner case 12.

Also, a rail mounting part 234 on which a rail assembly 250 for sliding the case door 220 to be inserted or withdrawn may be recessed from the bottom surface of the outer case 230. The rail assembly 250 that is inserted and withdrawn to open and close the case door 220 may be disposed outside the cryogenic case 210. Thus, the rail assembly 250 may not have an influence on the extremely low temperature within the cryogenic freezing compartment 200.

Also, a cover guide part 235 in which a rail cover 260 covering the rail assembly 250 to prevent the rail assembly 250 from being exposed to the outside when the case door 220 is opened and closed is accommodated may be disposed on the bottom surface of the outer case 230. The cover guide part 235 may be recessed from the bottom surface of the outer case 230 to accommodate the rail cover 260.

The cover guide part 235 may accommodate portions of the rail cover 260 and the rail assembly 250. Also, the cover guide part 235 may extend forward and backward to correspond to the insertion and withdrawal direction of the case door 220. Here, the rail cover 260 may be disposed outside rather than the rail assembly 250. Thus, while the case door 220 is inserted and withdrawn, the rail assembly 250 may be prevented from being exposed to the outside.

A door guide 270 may be disposed on the front surface of the cryogenic case 210. The door guide 270 may define the front surface of the cryogenic case 210. An opening of a center of the door guide 270 may have a size corresponding to that of the opened front surface of the inside case 240, and a circumference of the door guide 270 may correspond to that of the outer case 230.

Also, a side part 271 protruding forward may be further disposed on the front surface of the door guide 270. The side part 271 may come into contact with both left and right surfaces of the case door 220. When the case door 220 is closed, the side part 271 may be disposed at the same height as the front surface of the case door 220. The side part 271 may inform the completely closed state of the case door 220 to the user. Also, the side part 271 may come into contact with both side surfaces of the case door 220 to structurally prevent the cold air from laterally leaking from the cryogenic case 210. Also, the side part 271 may improve the outer appearance when the case door 220 is closed.

The case door 220 may include a front cover 221 defining an outer appearance of a front surface and a circumference of the case door 220 and a door case 222 defining a rear surface of the case door 220. The foamed insulation material 223 may be filled into the front cover 221 and the case door 220, and the case door 220 may have a thermally insulated structure.

A handle part 221*a* recessed inward may be disposed on a lower end of the front surface of the front cover 221. Thus, the user may push and pull the case door 220 in a state where the user's finger holds the handle part 221*a* to open and close the case door 220.

A circumference of the front surface of the door guide 270 may come into contact with a circumference of a rear surface of the case door 220. Also, a door gasket 290 may be disposed on the circumference of the case door 220 coming into contact with the circumference of the door guide 270. The door gasket 290 is configured to seal a space between the cryogenic case 210 and the case door 220. The door gasket 290 may be fixed and mounted on a gasket insertion groove 224 that is defined to be recessed in the door case 222.

Also, a frame mounting part 225 may be disposed on each of both sides of the rear surface of the case door 220. The frame mounting part 225 may be recessed from the rear surface of the door case 222 corresponding to an inner region of the door gasket 290 and be configured so that the support frame 280 inserted and withdrawn together with the case door 220 is fixed and mounted.

The support frame 280 may be fixed and mounted on the rear surface of the case door 220, and the cryogenic accommodation member 226 may be seated on the support frame 280. Thus, when the case door is slid to be inserted and withdrawn, the case door 220 may be inserted and withdrawn together with the support frame 280, and also, the cryogenic accommodation member 226 may be inserted and withdrawn together.

The support frame 280 may include a support plate 281 defining a bottom surface thereof and a frame fixing part 282 fixed to the case door 220.

In detail, the support plate 281 may provide a surface on which the cryogenic accommodation member 226 is seated. The support plate 281 may have a size that is capable of being inserted into the cryogenic case 210, i.e., the inside of the inside case 240.

An accommodation member seating part 283 may be recessed at a center of the support plate 281. The accommodation member seating part 283 may be recessed in a shape corresponding to the size of the bottom surface of the cryogenic accommodation member 226. A circumference of the accommodation member seating part 283 may protrude to accommodate at least a portion of the bottom surface of the cryogenic accommodation member 226. Thus, while the case door 220 is slid to be inserted and withdrawn, the cryogenic accommodation member 226 may be maintained in the stably mounted state.

A pair of plate extension parts 284 of which both left and right surfaces protrude backward may be further disposed on a rear end of the support plate 281. Also, a spacer 285 may be disposed on each of the pair of plate extension parts 284. The spacer 285 may allow the case door 220 to be smoothly slid to be inserted and withdrawn. In the state in which the spacer 285 is mounted on the support plate 281, the spacer 285 may come into contact with an inner surface of the inside case 240. Here, the spacer 285 may be made of an engineering plastic material having excellent abrasion resistance and excellent lubrication performance. Thus, when the case door 220 is inserted or withdrawn, the support plate 2891 may be smoothly slid by the guide of the spacer 285 without moving.

Also, the plate extension part 284 protrudes downward so that the plate extension part 284 come into contact with a stopper 243 protruding from the bottom surface of the inside case 240 when the case door 220 is fully withdrawn. Thus, when the case door 220 is opened, the excessive withdrawal of the case door 220 may be limited.

The frame fixing part 282 may extend upward from both left and right sides of the support plate 281. The frame fixing part 282 may be bent perpendicular to the support plate 281 and fixed to the frame mounting part 225 disposed on the rear surface of the door case 222. The frame fixing part 282 may be coupled to the frame mounting part 225 by a separate coupling member such as a screw and have a structure that is firmly coupled by using an adhesive or a coupling structure.

Also, in the state in which the frame fixing part 282 is mounted on the frame mounting part 225, the frame fixing part 282 may be disposed on the same plate as the case door 220, i.e., the rear surface of the door case 222. The frame fixing part 282 may be inserted into the recessed frame mounting part 225. In the state of being inserted, the frame fixing part 282 may be closely attached to the frame mounting part 225 and be integrated with the door case 222 to prevent the cryogenic accommodation member 226 from interfering when the cryogenic accommodation member 226 is detached.

The frame fixing part 282 may configured so that a protruding circumferential part 286 of the support plate extends. Thus, the frame fixing part 282 and the support plate 281 may have a structurally reinforced structure. That is, when the case door 220 is opened and closed, even though the withdrawal distance of the cryogenic accommodation member 226 is secured to be completely withdrawn, the stable support structure may be provided.

For this, the circumferential part 286 of the frame fixing part 282 and the support plate 281 may have a bent cross-sectional structure to effectively support a load applied to the support frame 280. Particularly, even when the case door 220 is withdrawn in a state in which foods are accommodated in the cryogenic accommodation member 226, the support frame 280 may not be deformed or droop, and a stable coupling structure with the case door 220 may be maintained.

The cryogenic accommodation member 226 may have a top surface with an opened basket shape. In the state in which the cryogenic accommodation member 226 is seated on the support frame 280, the cryogenic accommodation member 226 may be disposed at a height less than that of the door gasket 290 disposed on the case door 220. Thus, in the state in which foods are accommodated in the cryogenic accommodation member 226, when the case door 220 is opened and closed, the case door 220 may not interfere with the cryogenic case 210. Also, when the case door 220 is closed, an upper space of the cryogenic accommodation member 226 within the cryogenic case 210 may be secured to allow the cooling air for cooling the inside at an extremely low temperature to smoothly flow.

Also, an opened ventilation part 226*a* having a grill shape may be defined in the rear surface of the cryogenic accommodation member 226, i.e., a surface facing the thermoelectric module accommodation part 53. The ventilation part 226*a* may be defined in an entire rear surface of the cryogenic accommodation member 226. Thus, when the suction of air into the cryogenic case 210 and the discharge of air having the extremely low temperature are performed, the air may effectively flow by the ventilation part 226*a*.

A stepped part 226*b* of which a center protrudes, and a circumferential surface is recessed may be disposed on the bottom surface of the cryogenic accommodation part 226. The stepped part 226*b* may have a groove shape corresponding to be seated on the circumferential part 286 of the support plate 281 when the cryogenic accommodation member 226 is seated on the support plate 281. Thus, the stable mounting of the cryogenic accommodation member 226 may be realized, and the undesired separation of the cryogenic accommodation member 226 may be prevented.

Although the cryogenic accommodation member 226 is detached from the support plate 281 separately from the support plate 281, the support plate 281 may be integrated with the support plate 281 so that the support plate 281 itself is configured as the cryogenic accommodation member 226.

A cover mounting part 226 may be disposed on both sides of the lower end of the door case 222. When the front cover 221 and the door case 222 are coupled to each other, an opening of the cover mounting part 226 may be exposed to the rear side. The cover mounting part 226 may have a shape corresponding to the cross-sectional shape of the rail cover 260. Thus, the rail cover 260 may be configured to be mounted through the cover mounting part 226.

The rail cover 260 may be fixed to the case door 220 and may be configured to cover the rail assembly 250 while being withdrawn together with the case door 220. Also, the rail cover 260 includes a cover part 261 for covering the rail assembly 250 and a cover fixing part 262 for fixing the rail cover 260 to the case door 220.

The cover part 261 covers the side and exposed top surfaces of the rail assembly 250 and is configured to be coupled to the rail assembly 250 at the same time. The cover part 261 may extend in a direction in which the case door 220 is withdrawn to cover the rail assembly 250 when the case door 220 is maximally withdrawn.

Also, the cover part 261 may be bent several times in a direction crossing the extension direction of the cover part 261. In detail, the cover part 261 may include a coupling surface 265, a covering surface 264, and a guide surface 263.

The coupling surface 265 extends in parallel to the bottom surface of the cryogenic case 210 and the top surface of the rail assembly 250 and is coupled to a movable rail 253 extending to the outermost side from the rail assembly 250. That is, the movable rail 253 may be coupled to the bottom surface of the coupling surface 265, and thus, the coupling surface 265, i.e., the rail cover 260 may also move along the extension of the movable rail 253. Thus, the case door 220 and the cryogenic accommodation member 226 integrated with the case door 220 may also move.

The covering surface 264 may vertically bent downward from an outer end of the coupling surface 265. The covering surface 264 may further extend downward from a lower end of the rail assembly 250 or a lower end of the movable rail 253. Thus, while the case door 220 is opened, the covering surface 264 may cover the rail assembly 250 to prevent the rail assembly 250 from being laterally exposed.

The guide surface 263 is vertically bent upward from an outer end of the coupling surface 265. The guide surface 263 may be vertically bent in a direction opposite to an end opposite to the covering surface 264. The guide surface 263 is vertically disposed from the coupling surface 265 to pass through the front surface of the cryogenic case 210 to prevent the cover part 261 from moving in left and right sides or bent and additionally guide the sliding of the case door 220.

Also, the covering surface 264, the guide surface 263, and the covering surface 264 have a continuously bent structure. Due to this structure, strength of the cover part 261 may be reinforced, and an additional reinforcing structure and support structure to withstand the vertical load applied when the case door 220 is opened may be provided.

A front end of the cover part 261 may pass through the rear surface of the door case 222, and a rear end of the coupling surface 265 may be inserted to pass through the front surface of the cryogenic case 210. Also, the rail assembly 250 may be covered always at the side and downward sides irrespective of the opening and withdrawal distance of the case door 220. Thus, the rail assembly 250 may be prevented from being exposed to the outside under any condition during the opening and closing of the case door 220.

Also, the cover part 261 is not disposed inside the space inside the cryogenic case 210 but is provided outside the cryogenic case 210 so that operation defects due to the deformation of the cover part 261 or the formation of the dew condensation by the extremely low temperature of the inside of the cryogenic case 210 may be prevented from occurring.

The cover fixing part 262 may be bent upward from a front end of the cover part 261. The front end of the cover part 261 may pass through the cover mounting part 226 disposed on the lower end of the door case 222 and then disposed inside the case door 220. Also, the cover fixing part 262 may extend upward from the inside of the case door 220.

The cove fixing part 262 may be closely attached to the inner surface of the door case 222, i.e., a surface coming into contact with the foamed insulation material 81. Also, the cover fixing part 262 may be fixed and coupled to the door case 222 by using a coupling member such as a screw. The door case 222 may be coupled to the front cover 221 in the state of being coupled to the cover fixing part 262 to constitute the case door 220. In the state in which the door case 222 and the front cover 221 are coupled to each other, a foam solution may be injected to form the foamed insulation material 81.

The mounted position of the cover fixing part 262 may correspond to that of the frame fixing part 282. Thus, the cover fixing part 262 and the frame fixing part 282 may be fixed at once by using the one coupling member. In the state in which the case door 220 is completely assembled, the cover fixing part 262 may be disposed inside the door case 222, and the frame fixing part 282 may be outside the door case 222 to allow the case door 220 to be stably coupled.

Figure 12:
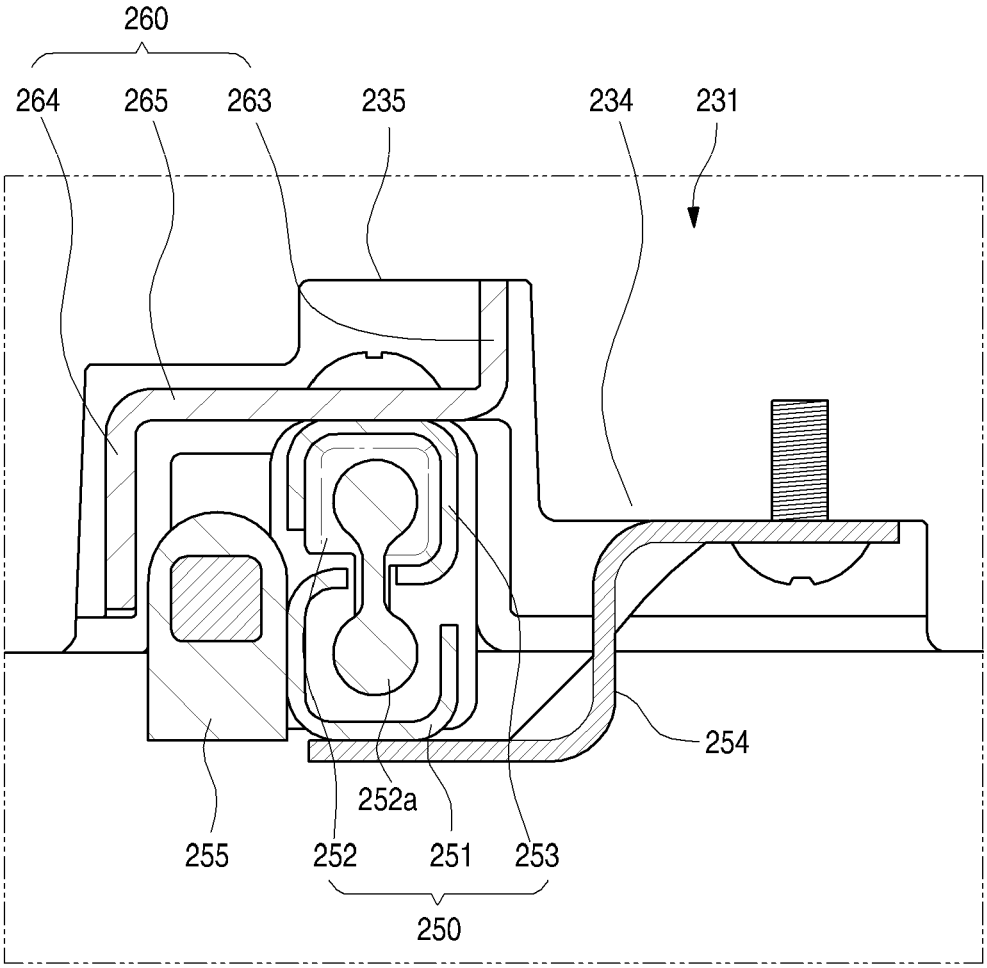
FIG. 12 is a cross-sectional view taken along line 12-12' of FIG. 11.

FIG. 12 is a cross-sectional view taken along line 12-12' of FIG. 11.

Referring to the drawings, in the detailed structure of the rail assembly 250, the rail assembly may extend in multi-stage, and thus, a multi-stage rail structure that is widely used for a drawer may be used.

Various rails having the rail structure that is inserted or withdrawn in multi-stage may be used. In this embodiment, three-stage rail assembly 250 may be will be described for convenience of explanation and understood.

The rail assembly may include a fixed rail 251, a connection rail 252, and a movable rail 253. The fixed rail 251 may be configured so that the rail assembly 250 is fixed and mounted on the bottom surface of the cryogenic case 210, i.e., the outer case 231.

As illustrated in FIG. 10, a fixing bracket 254 may be disposed on each of front and rear portions of the fixed rail 251. The fixing bracket 254 may be coupled to the rail mounting part 234 disposed on a bottom surface of the outer case 230. Thus, the fixed rail 251 may be fixed and mounted on the cryogenic case 210 by the fixing bracket 254.

Also, a damping device 255 for buffering an impact when the case door 220 is closed may be disposed on one side of the fixed rail 251. The damping device 255 may be a device for damping of the general drawer door, and various structures may be applied to the damping device 255.

Also, when the case door 220 is closed, although external force is not applied, the damping device 255 may be configured so that the case door 220 is completely closed by being pulled. That is, the damping device 255 may have an auto-closing function. The completely closed state of the case door 220 may be maintained to prevent the cold air within the cryogenic freezing compartment 200 from leaking to the outside.

The movable rail 253 may be coupled to the coupling surface of the rail cover 260 and then be inserted and withdrawn together with the case door 220 forward and backward. Here, the movable rail 253 may be disposed above the fixed rail 251. The movable rail 253 and the fixed rail 251 may be connected to each other through the connection rail 252 and thus withdrawn in two stages with respect to the fixed rail 251.

The connection rail 252 may be disposed between the fixed rail 251 and the movable rail 253. A plurality of bearings 252*a* may be provided in the connection rail 252 between the fixed rail 251 and the movable rail 253 so that the connection rail 252 and the movable rail 253 are slid to be inserted and withdrawn.

The movable rail 253 of the rail assembly 2500 may be fixed and mounted on the coupling surface 265 of the rail cover 260. In the state in which the rail assembly 250 is mounted, the covering surface 264 may extend to cover the movable rail 253.

Thus, the rail assembly 250 may guide of the slidable movement of the case door 220 through the above-described structure. Thus, the stable support structure may be applied to the rail cover 260 and prevent the rail assembly 250 from being laterally exposed.

Figure 14:
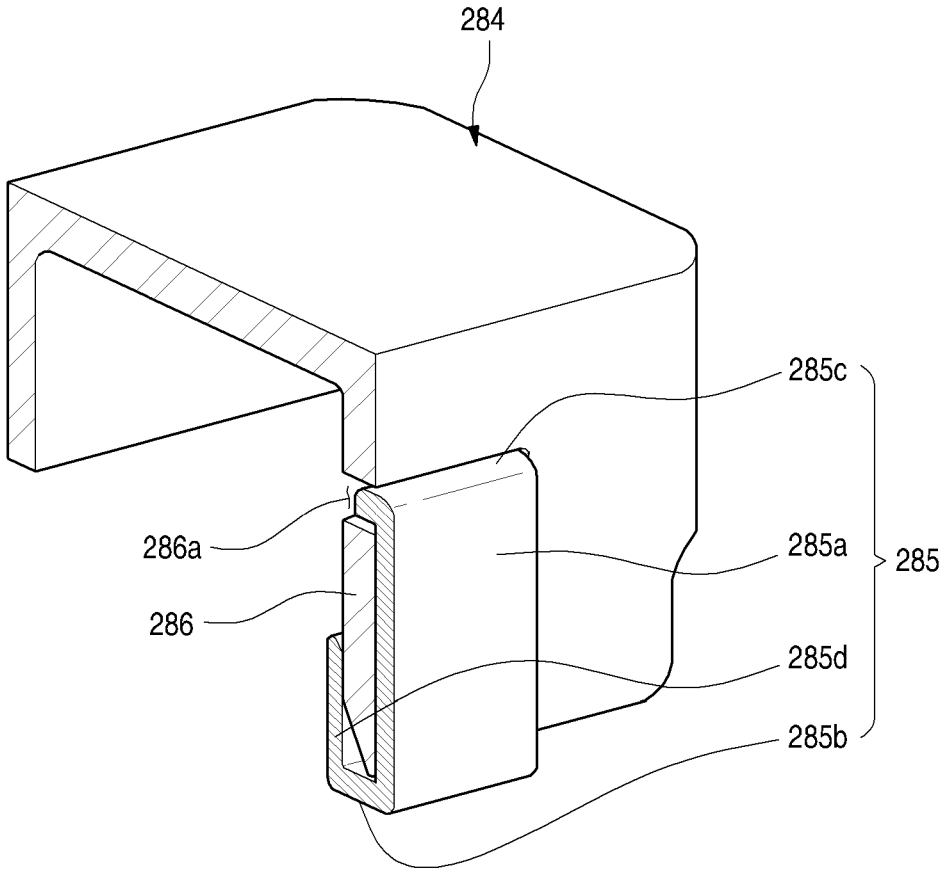
FIG. 14 is a cross-sectional view illustrating a coupling structure of the spacer.

FIG. 13 is a view illustrating a contact state of the spacer of the cryogenic freezing compartment. FIG. 14 is a cross-sectional view illustrating a coupling structure of the spacer.

Referring to the drawings, in the coupling structure of the spacer 285, the spacer 285 may be mounted on the plate extension part 284 on both side ends of the support plate 281 that is inserted and withdrawn together with the case door 220.

In detail, the plate extension part 284 may have a shape in which the circumferential part 286 of the support plate 281 is bent downward so that the plate extension part 284 is hooked with the stopper 243. Also, the extension part hole 286*a* may be defined in an outer surface of the plate extension part 284 so as to mount the spacer 285. Also, a case door mounting part 286 that is recessed so that the spacer 285 is inserted may be disposed on a lower portion of the extension part hole 286*a*.

The spacer 285 is inserted into the extension part hole 286*a* in the state in which the spacer 285 is mounted on the case door mounting part 286 to maintain the mounted state even though the support plate 281 is inserted and withdrawn forward and backward. The spacer 285 may be injection-molded by using an engineering plastic material and fixed and mounted on the plate extension part 284.

In detail, the spacer 285 may include a side part 285*a* coming into contact with the inner side surface of the inside case 240, a bottom part 285*b* coming into contact with the inner lower surface of the inside case 240, an insertion fixing part 285*c* extend from the side part 285*a* and inserted into the extension part hole 286*a*, and a bent part 285*d* bent from an end of the bottom part 285*b*.

In detail, the side part 285*a* may have a shape corresponding to the case door mounting part 286 and be inserted into the case door mounting part 286. Also, the side part 285*a* may be exposed to a side surface of the plate extension part 284 and protrude somewhat laterally. Thus, the space between the side surface of the support plate 281 and the inner surface of the inside case 240 may be filled.

Referring to FIG. 13, in the state in which the case door 220 is connected to the cryogenic case, the contact state between the spacer 285 and the inner surface of the inside case 240 may be maintained, In this state, the spacer 285 may be slid along the wall of the inside case.

An insertion fixing part 285*c* bent to the extension part hole 286*a* and inserted to pass through the extension part hole 286*a* may be disposed on an upper end of the side part 285*a*. The insertion fixing part 285*c* may prevent the spacer 285 from being separated while the case door 220 is inserted and withdrawn to restrict an upper end of the spacer 285.

The side part 285*a* may extend up to a lower end of the plate extension part 284. Also, the bottom part 285*b* may be bent from the lower end of the side part 285*a* and extend to pass through the lower end of the plate extension part 284. Here, the bottom part 285*b* may come into contact with an inner bottom surface of the inside case 240. That is, when the case door 220 is slid to be inserted and withdrawn, all of the side part 285*a* and the bottom part 285*b* may come into contact with the inner edges of the inside case 240. Thus, the case door 220 may be stably slid to be inserted and withdrawn without moving in the left and right directions.

A bent part 285*d* that is bent upward may be disposed on the extending end of the bottom part 285*b*. The bent part 285*d* may extend upward to define a space that is spaced apart from the side part 285*a*. Also, an end of the plate extension part 284 extending downward may be accommodated between the side part 285*a* and the bent part 285*d*. Also, the bent part 285*d* may be bent to press the inner surface of the plate extension part 284 and may fix the side part 285*a* so that the lower end of the side part 285*a* is maintained in the state of being mounted on the plate extension part 284.

The spacer 295 having the above-described structure may occupy a minimum space between the support plate 281 and the inside case 240 to minimize a space loss by occupying the very small space when compared with the structure such as the roller.

Also, the spacer 285 may be made of engineering plastic such as a POM having excellent lubrication performance so as not to interfere with the insertion and withdrawal operation of the rail assembly 250 and to assist the opening and closing of the case door 220.

Figure 15:
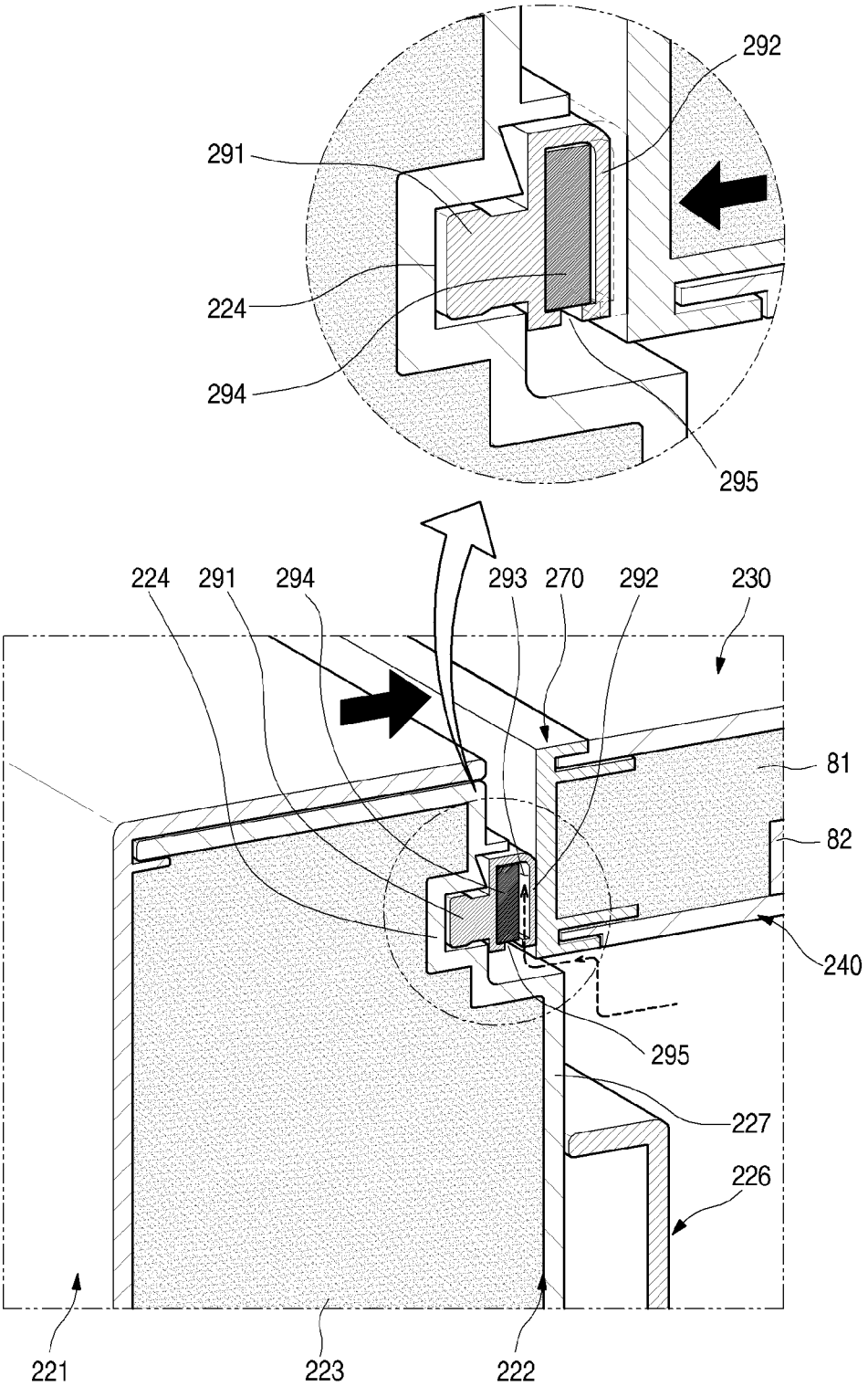
FIG. 15 is a cross-sectional view illustrating a coupling structure of a door gasket of the cryogenic freezing compartment.

FIG. 15 is a cross-sectional view illustrating a coupling structure of the door gasket of the cryogenic freezing compartment.

Referring to the drawing, in the coupling structure of the door gasket 290, the gasket insertion groove 224 may be recessed along an edge of the rear surface of the door case 222.

Also, an inner region of the gasket insertion groove 224 may have a case protrusion 227 that protrudes to be inserted into the opened bottom surface of the cryogenic case 210. Thus, a space between the case protrusion 227 and the inner surface of the inside surface 240 is structurally narrowed to reduce the leakage of the cold air.

Also, in the state in which the door gasket 290 is mounted on the gasket insertion groove 224, when the case door is completely closed, the door gasket 290 may come into contact with the circumference of the front surface of the cryogenic case 210, i.e., the front surface of the door guide 270. The door gasket 290 and the door guide 270 may be closely attached to each other to completely seal the cryogenic case 210, thereby preventing the cold air within the door gasket 290 from leaking to the outside.

The door gasket 290 may be made of a silicone material capable of maintaining sealing performance and elasticity even at the extremely low temperature. Also, the door gasket 290 may include a gasket mounting part 291 inserted into and mounted on the gasket insertion groove 224 and a sealing part 292 coming into contact with the front surface of the cryogenic case 210 to provide an insulation space.

The gasket mounting part 291 may be press-fitted into the gasket insertion groove 224. Also, the sealing part 292 may be disposed on the gasket mounting part 291 that is exposed to the outside of the gasket insertion groove 224.

The sealing part 292 may provide the insulation space 292 therein and have a gasket opening 295 toward the case protrusion 227. In detail, a predetermined insulation space 293 communicating with the gasket opening 295 may be provided in the inside of the sealing part 292. An insulation member 294 is disposed in the insulation space 293.

The insulation member 294 may be disposed over the entire door gasket 290 along the insulation space 293. Also, the insulation member 294 may be made of an EPDM foam and be elastically deformable. Also, the insulation member 294 may have a size that is slightly less than that of the insulation space 293. The insulation member 294 may be fixed to the inner surface of the sealing part 292 coming into contact with the gasket mounting part 291 and be spaced apart from the sealing part on the opposite surface, i.e., the surface facing the cryogenic case 210.

Thus, in the state in which the case door 220 is closed, the sealing part 292 may be deformed, and the insulation member 294 may be pressed to seal the cryogenic freezing compartment 200. Here, the insulation space within the door gasket 290 may be actually filled with the insulation member 294 to allow the door gasket 290 to perform the insulation function and block the heat exchange within the cryogenic freezing compartment 200.

When cooling air within the cryogenic case 210 may be supplied, the inner pressure of the cryogenic case 210 may increase somewhat. In this state, the case door 220 may finely move by the pressure. Here, when the air of the cryogenic freezing compartment 200 flows between the case protrusion 227 and the inner surface of the cryogenic case 210, the flowing air may flow to the door gasket 290 and then be introduced into the gasket opening 292 of the door gasket 290. When the cooling air is introduced into the gasket opening 295, the sealing part 292 may be expanded so that the sealing part 292 is more closely attached to the front surface of the cryogenic case 210. Thus, the sealed state of the cryogenic freezing compartment 200 may be maintained by the door gasket 290.

The case door 220 maintains the closed state unless sufficient external force is applied by the rail assembly 250. In particular, due to the auto-closing action by the damping member 255, it is not be easily opened only by the temporary pressure change of the valve.

Hereinafter, an opening and closing operation of the cryogenic freezing compartment 200 having the above-described structure will be described.

Figure 16:
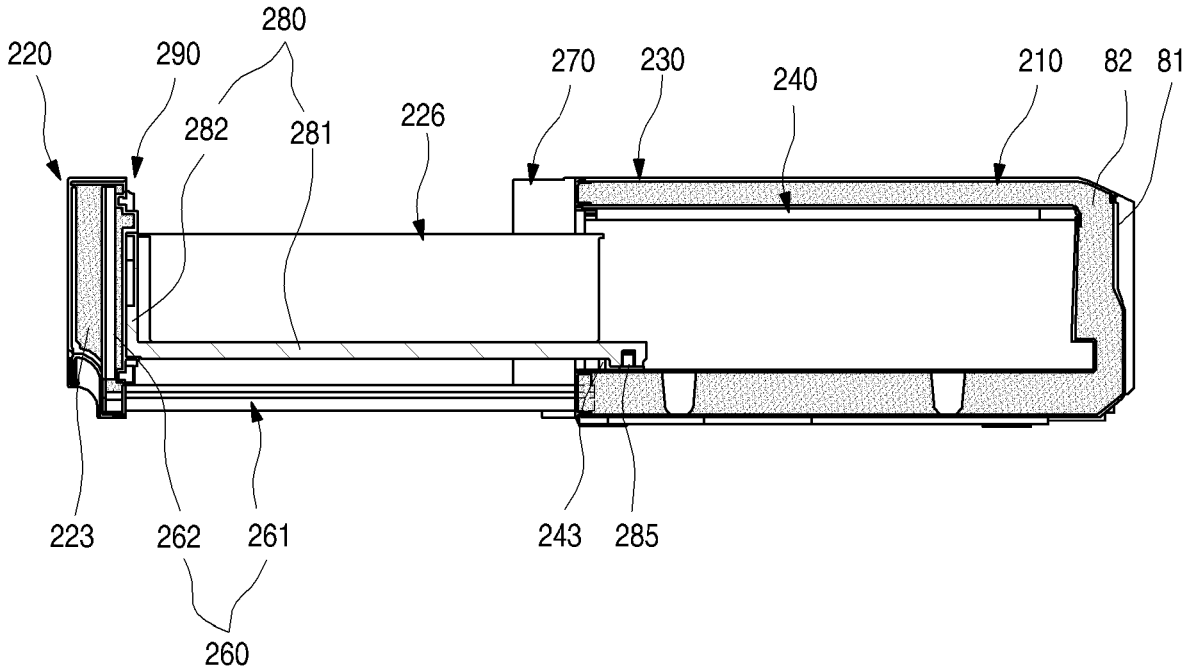
FIG. 16 is a cross-sectional view illustrating a state in which the cryogenic freezing compartment is closed.
Figure 17:
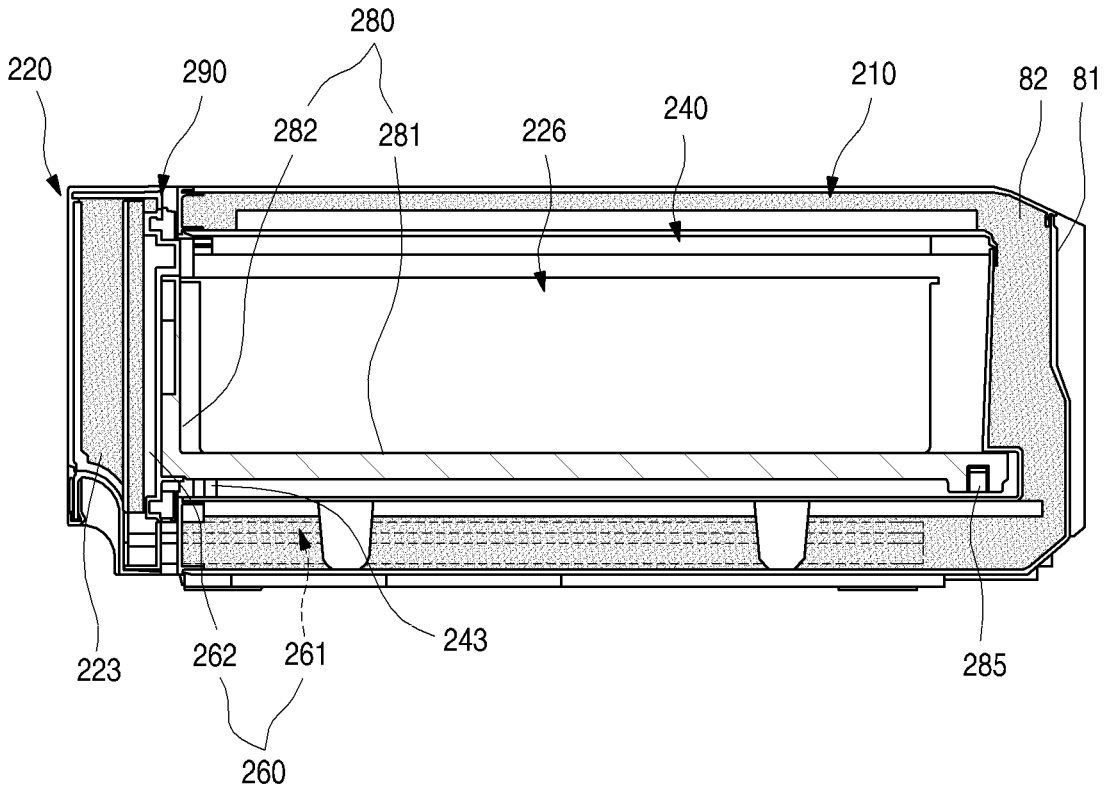
FIG. 17 is a cross-sectional view illustrating a state in which the cryogenic freezing compartment is opened.

FIG. 16 is a cross-sectional view illustrating a state in which the cryogenic freezing compartment is closed. FIG. 17 is a cross-sectional view illustrating a state in which the cryogenic freezing compartment is opened.

As illustrated in FIG. 16, the cryogenic freezing compartment may be maintained at the extremely low temperature by the cold air supplied in the state in which the case door 220 is closed. In the state in which the cryogenic freezing compartment 200 is closed, the door gasket 290 may press and be closely attached to the circumference of the front surface of the cryogenic case 210.

In this state, the inside of the door gasket 290 is filled with the insulation member 294 to prevent the cold air from leaking between the case door 220 and the cryogenic case 210 and also prevent the heat from being transferred through the cryogenic gasket 290. Particularly, a temperature difference between the cryogenic freezing compartment 200, which is in the extremely low temperature state, and the freezing compartment 40 may increase to cause the heat exchange. Thus, the door gasket 290 may have the insulation structure to prevent the inner temperature of the cryogenic freezing compartment 200 from being reduced.

In the state in which the case door 220 is completely closed, the support plate 281 that is inserted and withdrawn together with the case door 220 may also be maintained in the state of being completely inserted into the cryogenic case 210.

Also, since the cryogenic accommodation member 226 seated on the support plate 281 is completely inserted into the cryogenic case 210, the cold air having the extremely low temperature may be introduced into the cryogenic accommodation member 226 by the cooling fan 190.

Also, the rail assembly 250 may be completely inserted, and the rail cover 260 may also be accommodated into the bottom surface of the cryogenic case 210 and thus may not be exposed to the outside.

In this state, when the user grips the case door 220 to hold the foods in the cryogenic freezing compartment 200 and pulls the case door 220 forward, the case door 220 is slid forward and the cryogenic freezing compartment 200 is opened.

As the case door 220 moves forward, the rail assembly 250 may extend in the multi-stage, and the case door 220 and the support plate 281 may be withdrawn due to the multi-stages of the rail assembly 250. Also, when the case door 220 is withdrawn, the rail cover 260 may also be withdrawn together. Thus, the rail assembly 250 extending by the withdrawal of the rail cover 260 may be covered from the side and upper sides to prevent the rail assembly 250 from being exposed to the outside.

When the case door 220 is withdrawn, the spacer 285 disposed on the plate extension part 284 of the support plate 281 may be maintained in the contact state with the inner surface of the inside case 240 and then move along the edge of the lower ends of both surfaces of the inside case 240 to prevent the case door 220 from moving and drooping.

The case door 220 is withdrawn as illustrated in FIG. 17. When the withdrawal of the case door 220 is completed, the rail assembly 250 may maximally extend. Also, in the state in which the case door 220 is maximally withdrawn, the downwardly protruding front end of the plate extension part 284 may come into contact with the stopper 243 protruding from the bottom surface of the inside case 240 and thus may not be withdrawn any more.

Also, in the state in which the case door 220 is maximally withdrawn, the cryogenic accommodation member 226 may be completely withdrawn from the inside of the cryogenic case 210. Thus, the cryogenic accommodation member 226 may be separated from the support plate 281. That is, as illustrated in FIG. 17, in the state in which the cryogenic accommodation member 226 is completely withdrawn, the foods may be easily accommodated, and the cryogenic accommodation member 226 may be easily processed.

As illustrated in FIG. 17, in the state in which the case door 220 is maximally withdrawn, the support structure of the case door 220 by the rail cover 260 as well as the rail assembly 250 may be additionally provided to prevent the case door 220 from drooping and also prevent the case door 220 from moving and drooping by the support plate 280.

Also, when the accommodation of the foods is completed, the case door 220 may be pushed again, and the cryogenic freezing compartment 200 is closed as illustrated in FIG. 16.

Hereinafter, a structure and an operation state for operating the cryogenic freezing compartment 200 capable of realizing such an extremely low temperature will be described with reference to the drawings.

Figure 18:
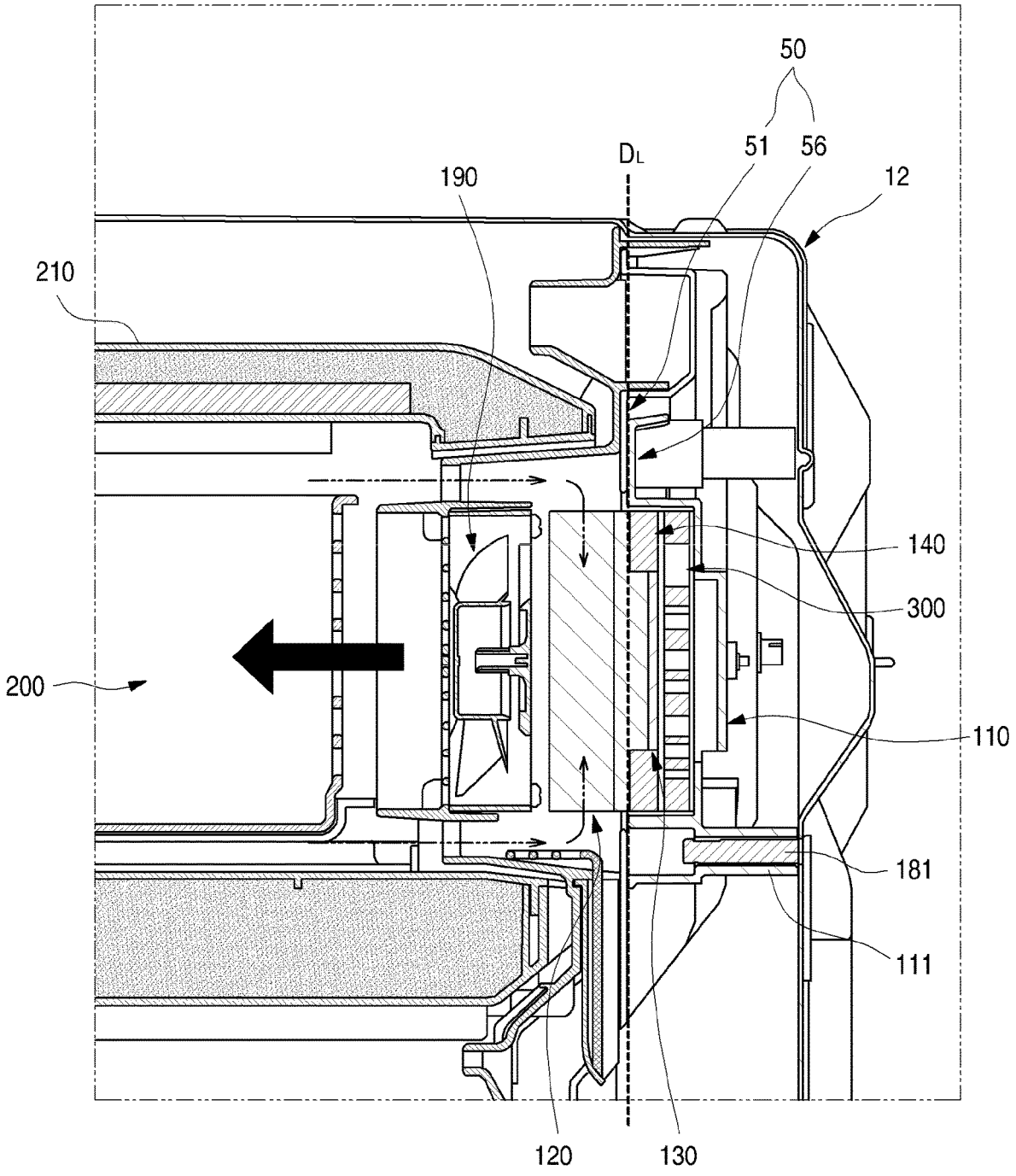
FIG. 18 is a cross-sectional view of an air flow state for cooling the cryogenic freezing compartment.

FIG. 18 is a cross-sectional view illustrating an air flow state for cooling the cryogenic freezing compartment. A cryogenic case 210 providing the cryogenic freezing compartment 200 is mounted inside the refrigerating compartment 30. The opened rear surface of the cryogenic case 210 is closely attached to the grill fan 51. Also, the thermoelectric module accommodation part 53 on which the thermoelectric module assembly 100 and the cooling fan 190 are mounted may be inserted through the opened rear surface of the cryogenic case 210 to supply cold air into the cryogenic freezing compartment 200.

The thermoelectric module assembly 100 may be disposed at the rear side of the cooling fan 190 and fixedly mounted on the grill fan assembly 50 and the inner case 12 in the state of being accommodated into and assembled with the inside of the module housing 110.

Here, a portion, at which the cold air is generated, of the thermoelectric module assembly 100 may be disposed inside the cryogenic freezing compartment 200, and a portion, at which heat is generated, of the thermoelectric module assembly 100 may be disposed inside the space in which the evaporator 77 is accommodated.

The arrangement of the thermoelectric module assembly will be described in more detail with reference to an extension line $D_L$ of the front surface of the shroud 56 that is the boundary between the cryogenic freezing compartment 200 and the accommodation space of the evaporator 77.

The heat absorption side of the thermoelectric module assembly 100 may be disposed at the front, and the heat dissipation side may be disposed at the rear with respect to the extension line $D_L$. Here, the extension line $D_L$ may be the boundary between the refrigerating compartment and the space in which the evaporator 77 is accommodated and be defined as the rear surface of the grill fan 51, but not the front surface of the shroud 56.

That is, in the thermoelectric module assembly 100 is mounted, the cold sink 120 may be disposed at a front side of the extension line $D_L$, and the rear surface of the cold sink 120 may be disposed on the extension line $D_L$.

Thus, the whole cold sink 120 from which the cold air is generated may be disposed inside the cryogenic freezing compartment 200, i.e., inside the thermoelectric module accommodation part 53. Thus, the cold sink 120 may be disposed in an independent space with respect to the heat sink 300 to completely supply the cold air generated from the cold sink 120 into the cryogenic freezing compartment 200. Here, when the cold sink 120 is disposed further backward, a portion of the cold sink 120 may be output of the area of the cryogenic freezing compartment 200 to deteriorate the cooling performance. Also, when the cold sink 120 is disposed further forward, the cryogenic freezing compartment 200 may be reduced in volume.

All the heat sink 300, the insulation material 140, and the thermoelectric module 130 may be disposed at the rear side with respect to the extension line $D_L$, and the front surface of the insulation material 140 coming into contact with the rear surface of the cold sink 120 may be disposed on the extension line $D_L$. The insulation material 140 may substantially cover an opening in the extension line $D_L$ to completely block the heat transfer between the cold sink 120 and the heat sink 300.

Also, the heat sink 300 is disposed on a region in which the evaporator 77 is accommodated, i.e., a region between the grill fan assembly 50 and the inner case 12, and the refrigerant supplied to the evaporator 77 cools the heat sink 300. The cooling performance of the thermoelectric module 130 may be maximized through the cooling of the heat sink 300 using the low-temperature refrigerant. The heat sink 300 may be additionally cooled using the cold air of the evaporator 77 by the module housing 110 spaced apart from the inner case 12.

As described above, the thermoelectric module assembly 100 may dissipate heat in the region in which the evaporator 77 is disposed and absorb heat in the cryogenic freezing compartment 200 to cool the cryogenic freezing compartment 200 to the extremely low-temperature state.

According to the embodiments, the low-temperature refrigerant supplied to the evaporator may pass through the heat sink of the thermoelectric module assembly for cooling the cryogenic freezing compartment to increase in temperature difference between the heat absorption surface and the heat generation surface of the thermoelectric module, and thus, the cryogenic freezing compartment may realize the extremely low temperature of about −40° C. to about −50° C.

Also, the front surface of the cryogenic freezing compartment may be opened and configured so that the opened front surface is opened and closed by the slidably insertable and withdrawable door. Here, the rail assembly for sliding the door may be provided outside of the cryogenic freezing compartment, but inside of the cryogenic freezing compartment. Thus, the deformation and damage of the rail assembly due to the extremely low temperature of the cryogenic freezing compartment may be prevented, and also, the operational performance may be prevented from being deteriorated due to the formation of the dew condensation on the rail assembly or the frozen rail assembly.

Also, the rail cover covering the rail assembly may be provided to prevent the rail assembly from being exposed to the outside during the insertion and withdrawal of the door, and thereby improving the outer appearance and preventing safety accidents from occurring.

Also, the rail cover may have a structure that is bent several times and be configured to connect the cryogenic case of the cryogenic freezing compartment to the door. Thus, even though the withdrawn direction of the door increases, the reinforcing support structure using the rail cover may be provided to prevent the door from drooping or moving.

Also, the support frame may be disposed on the rear surface of the door to support the inside of the cryogenic case. Thus, even though the withdrawn direction increases, and the cryogenic accommodation member is completely withdrawn, the drooping or moving of the door due to the applying of the load to the door may be prevented.

Particularly, the rail cover and the support frame may be bent at the portions that are coupled to the door to realize the stable coupling structure with the door, thereby allowing the door to more effectively stably endure the vertical load. Also, the cryogenic accommodation member may be completely withdrawn due to the above-described structure.

Also, the spacer having the abrasion resistance and the lubrication may be disposed on each of both sides of the rear end of the support frame to come into contact with the left and right edges of the lower portion of the cryogenic freezing compartment. Therefore, the support structure by the spacer may be provided during the insertion and withdrawal of the door to allow the door to be more smoothly inserted and withdrawn and provide more stable support structure to the door.

Also, the space required for the installation and operation of the spacer may be minimized due to the characteristics in installation structure. When compared with the case in which the structure such as the roller is provided, the space loss of the cryogenic freezing compartment may be minimized.

Also, the door basket may be disposed on the rear surface of the door, and the insulation member may be provided in the door gasket to provide the sealing between the door and the cryogenic case and the insulation of the door gasket, thereby preventing the inner temperature of the cryogenic case, which is the extremely low temperature, from increasing.

Also, in the door gasket, the gasket opening may be defined in the path through which the air within the cryogenic freezing compartment is guided. Thus, even though the door is temporarily closed without being completely closed, the gasket may be closely attached to the cryogenic case by the cold air introduced into the gasket opening to maintain the sealed state between the door and the cryogenic gasket.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body that defines a storage space;

a cryogenic freezing compartment located in the storage space and configured to maintain a temperature that is less than a temperature of the storage space; and a thermoelectric module assembly located at a side of the cryogenic freezing compartment and configured to cool the cryogenic freezing compartment, wherein the cryogenic freezing compartment comprises:

a cryogenic case that includes an insulation material configured to insulate the cryogenic freezing compartment from the storage space, the cryogenic case defining a cryogenic freezing space, a case door configured to open and close at least a portion of the cryogenic case, a rail assembly including one or more rails located at the cryogenic case outside of the cryogenic freezing space and configured to connect the case door to the cryogenic case, the rail assembly being configured to extend from and retract to the cryogenic case to cause the case door to withdraw from and insert to the cryogenic case, respectively, a rail mounting recess defined at a bottom surface of the cryogenic case and configured to couple to the rail assembly, a rail cover that is coupled to a rear surface of the case door, that is configured to cover the rail assembly, and that is configured to move relative to the rail assembly, and a cover guide part defined at the bottom surface of the cryogenic case and configured to receive the rail cover based on insertion and withdrawal of the case door with respect to the cryogenic case.

2. The refrigerator according to claim 1, wherein the rail cover comprises:

a cover part that extends from a lower end of the rear surface of the case door to a front surface of the cryogenic case; and a cover fixing part that extends upward from a front end of the cover part and that is configured to couple to an inside of the case door.

3. The refrigerator according to claim 2, wherein the cover part comprises:

a coupling surface configured to couple to the rail assembly and to move together with the rail assembly based on extension and retraction of the rail assembly with respect to the cryogenic case;

a side cover surface that is bent from an outer end of the coupling surface toward the rail assembly and that covers an outer portion of the rail assembly; and a guide surface that is bent from an inner end of the coupling surface toward the cover guide part and that is configured to guide movement of the rail cover in the cover guide part.

4. The refrigerator according to claim 1, wherein the cryogenic freezing compartment further comprises a support frame configured to receive food and located at a rear surface of the case door, and wherein the support frame is configured to, based on the case door being opened and closed, withdraw from and insert into the cryogenic freezing space within the cryogenic case, respectively.

5. The refrigerator according to claim 4, wherein the support frame comprises:

a pair of frame fixing parts that are configured to couple to the rear surface of the case door and that extend in a vertical direction with respect to a bottom surface of the cryogenic case; and a support plate that extends rearward from lower ends of the pair of frame fixing parts, that is configured to support food, and that is located vertically above the rail assembly.

6. The refrigerator according to claim 5, wherein the cryogenic freezing compartment further comprises a cryogenic accommodation member that is configured to receive food, that is located on the support plate, and that is configured to withdraw outside of the cryogenic case based on the case door being opened.

7. The refrigerator according to claim 4, wherein the cryogenic freezing compartment further comprises a spacer that is located at a rear end of the support frame between a side surface of the support frame and an inner surface of the cryogenic freezing compartment, that is configured to contact the inner surface of the cryogenic freezing compartment, and that is configured to guide the support frame to insert into and withdraw from the cryogenic freezing compartment.

8. The refrigerator according to claim 7, wherein the spacer comprises a plastic material configured to reduce abrasion and friction between the spacer and the inner surface of the cryogenic freezing compartment.

9. The refrigerator according to claim 7, wherein the spacer comprises a pair of spacers that face inner surfaces of the cryogenic freezing compartment, each spacer being configured to contact a lower end of a respective inner surface of the cryogenic freezing compartment, and wherein the support frame is configured to insert into and withdraw from the cryogenic freezing compartment based on each spacer maintaining contact with the lower end of the respective inner surface of the cryogenic freezing compartment.

10. The refrigerator according to claim 7, wherein the spacer comprises:

a side part configured to contact the inner surface of the cryogenic freezing compartment; and a bottom part that is bent from a lower end of the side part and that is configured to contact a bottom surface of the cryogenic freezing compartment.

11. The refrigerator according to claim 10, wherein the spacer further comprises:

an insertion fixing part that is located at an upper end of the side part of the spacer and that is configured to insert to the support frame; and a bent part that extends upward from the bottom part of the spacer and that is configured to receive an end of the support frame.

12. The refrigerator according to claim 1, wherein the cryogenic freezing compartment further comprises a cryogenic gasket located at a circumference of a rear surface of the case door and configured to contact a front surface of the cryogenic case, and wherein the cryogenic gasket comprises:

a first part configured to couple to the rear surface of the case door, and a second part that protrudes rearward from the first part and that is configured to contact the front surface of the cryogenic case, the second part surrounding an empty inner space within the cryogenic gasket.

13. The refrigerator according to claim 12, wherein the cryogenic gasket further comprises an insulation member disposed in at least a portion of the inner space of the second part of the cryogenic gasket, the insulation member comprising an elastic material configured to insulate the cryogenic freezing compartment from the storage space.

14. The refrigerator according to claim 12, wherein the cryogenic case defines an opening at the front surface of the cryogenic case, wherein the case door includes a case protrusion that protrudes from the rear surface of the case door toward the cryogenic case and that is configured to insert into the opening defined at the front surface of the cryogenic case, and wherein the cryogenic gasket is disposed around a circumference of the case protrusion.

15. The refrigerator according to claim 14, wherein the second part of the cryogenic gasket defines a gasket opening that faces toward the case protrusion.

16. The refrigerator according to claim 1, wherein the rail assembly comprises a plurality of rails and is configured to extend or retract in multiple stages based on relative movement of the plurality of rails.

17. The refrigerator according to claim 16, wherein the plurality of rails comprise:

a first rail coupled to the cryogenic case; and a second rail coupled to the case door and configured to move relative to the first rail.

18. The refrigerator according to claim 17, wherein the plurality of rails further comprise a third rail that is located between the first rail and the second rail and that is configured to move relative to the first rail and the second rail, the third rail including a plurality of rollers.

* * * * *